US009533516B2

(12) United States Patent
Kashiwagi et al.

(10) Patent No.: US 9,533,516 B2
(45) **Date of Patent: *Jan. 3, 2017**

(54) PRINTING APPARATUS AND METHOD FOR CONTROLLING THE SAME

(71) Applicant: CANON KABUSHIKI KAISHA, Tokyo (JP)

(72) Inventors: Masaki Kashiwagi, Hiratsuka (JP); Tomoki Sugahara, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/815,049

(22) Filed: Jul. 31, 2015

(65) Prior Publication Data

US 2015/0336408 A1 Nov. 26, 2015

Related U.S. Application Data

(63) Continuation of application No. 13/941,885, filed on Jul. 15, 2013, now Pat. No. 9,128,446.

(30) Foreign Application Priority Data

Jul. 17, 2012 (JP) ..... 2012-158335
Feb. 22, 2013 (JP) ..... 2013-032893

(51) Int. Cl.
*G03G 15/00* (2006.01)
*B65H 37/04* (2006.01)
*B41J 13/00* (2006.01)

(52) U.S. Cl.
CPC ..... *B41J 13/0045* (2013.01); *G03G 15/502* (2013.01); *G03G 15/6541* (2013.01)

(58) Field of Classification Search
CPC .... G03G 15/00; G03G 21/00; G03G 15/6541; G03G 15/502; B65H 37/04
(Continued)

(56) References Cited

U.S. PATENT DOCUMENTS 5,913,099 A * 6/1999 Kamei ..... G03G 15/6544 270/12
6,330,422 B1 * 12/2001 Sato ..... G03G 15/6541 399/382
(Continued)

FOREIGN PATENT DOCUMENTS

JP 11243486 A * 9/1999 ..... G03G 21/00
JP 2001-038967 A 2/2001
(Continued)

*Primary Examiner* — Nguyen Ha
(74) *Attorney, Agent, or Firm* — Canon USA, Inc. I.P. Division

(57) ABSTRACT

A control method for controlling a printing apparatus includes printing an image on a sheet; receiving the printed sheet subjected to post-processing; controlling, in a case where the printed sheet subjected to post-processing is to be received in a first orientation, to perform post-processing to the received printed sheet without reversing the printed sheet, and, controlling, in a case where the printed sheet subjected to post-processing is to be received in a second orientation, to perform post-processing to the received printed sheet after reversing the printed sheet; and displaying, in a case where the printed sheet subjected to post-processing is to be received in the second orientation and a type of the sheet subjected to image printing and post-processing is of a type unsuitable for reversal, a screen for changing the type of the sheet to be used for printing and post-processing.

21 Claims, 17 Drawing Sheets

■ REVERSE PRINTING, FACE-UP OUTPUT PATTERN (MARKED ★)
■ FORWARD PRINTING, FACE-DOWN OUTPUT PATTERN (UNMARKED)

DISCHARGE DIRECTION

| STAPLING POSITION SPECIFICATION | PORTRAIT | LANDSCAPE |
|---|---|---|
| NONE | | |
| UPPER LEFT | | ★ |
| LOWER LEFT | ★ | |
| UPPER RIGHT | ★ | |
| LOWER RIGHT | | ★ |

(58) Field of Classification Search
USPC ..... 399/410
See application file for complete search history.

(56) References Cited

U.S. PATENT DOCUMENTS

| | | | | |
|---|---|---|---|---|
| 8,262,075 | B2 * | 9/2012 | Shiraishi | B31F 5/027 270/58.08 |
| 8,641,030 | B2 * | 2/2014 | Sato | B41J 13/106 270/58.09 |
| 9,128,446 | B2 * | 9/2015 | Kashiwagi | G03G 15/502 |
| 2001/0021317 | A1 * | 9/2001 | Shimada | B41J 13/106 399/82 |
| 2007/0069452 | A1 * | 3/2007 | Murata | B42C 1/00 271/186 |
| 2007/0242999 | A1 * | 10/2007 | Tao | B41J 3/60 400/76 |
| 2010/0123940 | A1 * | 5/2010 | Kamisuwa | G03G 15/5025 358/452 |
| 2011/0236158 | A1 * | 9/2011 | Shiraishi | B31F 5/027 412/33 |
| 2013/0222819 | A1 * | 8/2013 | Johnson | G06K 15/1823 358/1.6 |

FOREIGN PATENT DOCUMENTS

| | | | | |
|---|---|---|---|---|
| JP | 2001-192164 | A | 7/2001 | |
| JP | 2001249572 | A * | 9/2001 | B65H 37/04 |
| JP | 2001-318494 | A | 11/2001 | |
| JP | 2002308522 | A * | 10/2002 | B65H 37/04 |
| JP | 2003337508 | A * | 11/2003 | B65H 37/04 |
| JP | 2006301294 | A * | 11/2006 | B65H 37/04 |
| JP | 2007-094141 | A | 4/2007 | |
| JP | 2009-224973 | A | 10/2009 | |
| JP | 2010-159130 | A | 7/2010 | |
| JP | 2011209460 | A * | 10/2011 | G03G 15/00 |

* cited by examiner

FIG.6

- REVERSE PRINTING, FACE-UP OUTPUT PATTERN (MARKED ★)
- FORWARD PRINTING, FACE-DOWN OUTPUT PATTERN (UNMARKED)

DISCHARGE DIRECTION

| STAPLING POSITION SPECIFICATION | PORTRAIT | LANDSCAPE |
|---|---|---|
| NONE | | |
| UPPER LEFT | | ★ |
| LOWER LEFT | ★ | |
| UPPER RIGHT | ★ | |
| LOWER RIGHT | | ★ |

PRINTING APPARATUS AND METHOD FOR CONTROLLING THE SAME

CROSS REFERENCE OF RELATED APPLICATIONS

This application is a continuation of U.S. application Ser. No. 13/941,885 filed Jul. 15, 2013 which claims the benefit of Japanese Patent Applications No. 2012-158335 filed Jul. 17, 2012 and No. 2013-032893 filed Feb. 22, 2013, each of which are hereby incorporated by reference herein in their entirety.

BACKGROUND OF THE INVENTION

Field of the Invention

The present invention relates to a printing apparatus and a method for controlling the printing apparatus.

Description of the Related Art

There has conventionally been a printing apparatus capable of binding a plurality of sheets by using a stapler finisher. Although many of stapler finishers have two or more physically staplable positions, some stapler finishers have only one physically staplable position for cost reduction. Japanese Patent Application Laid-Open No. 2005-88375 discusses a technique for controlling a stapler finisher having only one staplable position. Specifically, the technique uses forward printing (printing from the first page in ascending order of page number) and reverse printing (printing from the last page in descending order of page number) in different ways to increase the number of staplable positions.

With a stapler finisher having only one staplable position, the sheet discharge surface needs to be changed depending on a stapling position specification. For example, with a printing apparatus which discharges sheets face-down and performs stapling in the case of one-sided forward printing, it is necessary, in the case of one-sided reverse printing, to discharge sheets face-up by reversing each sheet and perform stapling. When a sheet is reversed, the curvature of the conveyance path and the influence of rollers may crease or break the sheet depending on the sheet type.

Depending on the sheet type, paper jam may occur, thus causing a problem of user inconvenience.

SUMMARY OF THE INVENTION

According to an aspect of the present invention, a printing apparatus includes a printing unit configured to print an image on a sheet; a reversing unit configured to reverse the printed sheet; a post-processing unit configured to perform post-processing to the printed sheet; a receiving unit configured to receive the printed sheet in a position subjected to post-processing by the post-processing unit; a control unit configured to control the reversing unit and the post-processing unit such that, in a case where the printed sheet subjected to post-processing by the post-processing unit is to be received in the position in a first orientation, control the reversing unit not to reverse the printed sheet and the post-processing unit to perform post-processing to the printed sheet received by the receiving unit, and, in a case where the printed sheet subjected to post-processing by the post-processing unit is to be received in the position in a second orientation, control the reversing unit to reverse the printed sheet and the post-processing unit to perform post-processing to the printed sheet received by the receiving unit after the reversing unit reverses the printed sheet; and a display unit configured to, in a case where the printed sheet subjected to post-processing by the post-processing unit is to be received in the position in the second orientation and the sheet subjected to image printing by the printing unit and post-processing by the post-processing unit is of a type unsuitable for reversal, display a screen for a user to change the type of the sheet to be used for printing by the printing unit and post-processing by the post-processing unit.

Further features of the present invention will become apparent from the following description of exemplary embodiments with reference to the attached drawings.

BRIEF DESCRIPTION OF THE DRAWINGS

FIG. 6 illustrates a relation between a stapling position specification and sheet conveyance control of the printing apparatus.

DESCRIPTION OF THE EMBODIMENTS

Various exemplary embodiments, features, and aspects of the invention will be described in detail below with reference to the drawings.

Figure 1:
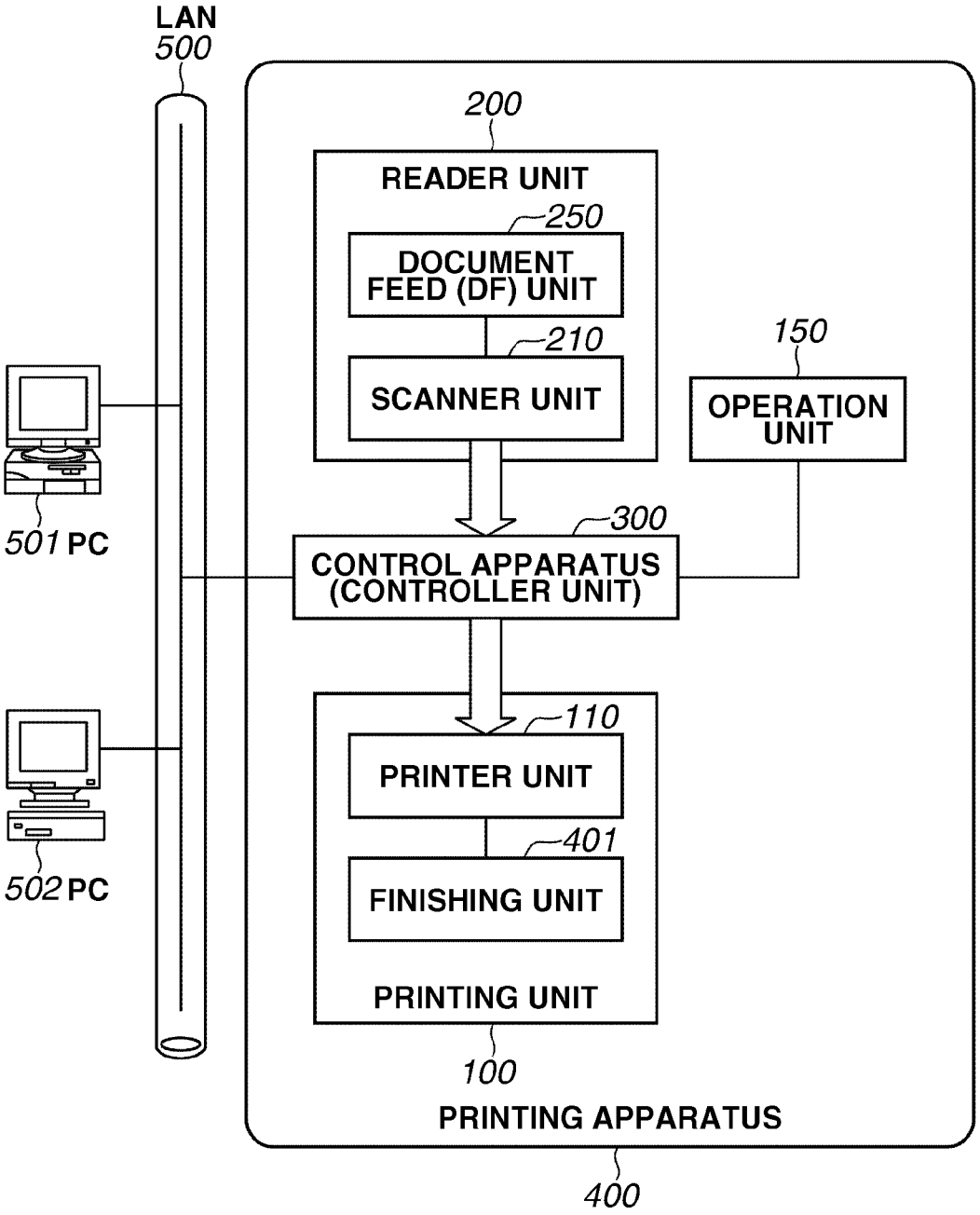
FIG. 1 illustrates an example printing system employing a printing apparatus.

FIG. 1 illustrates an example printing system employing a printing apparatus according to an exemplary embodiment of the present invention. In this example system, a controller unit (control apparatus) 300 is communicably connected with host computers (PCs) 501 and 502 via a local area network (LAN) 500.

Referring to FIG. 1, the controller unit 300 of a printing apparatus 400 is connected to the host computers 501 and 502 via the LAN 500, such as Ethernet. The LAN 500 may be a wireless LAN.

The printing apparatus 400 include s reader unit 200 for reading image data, and a printing unit 100 for outputting the image data. The printing apparatus 400 further includes an operation unit 150 provided with a keyboard for inputting and outputting image data, and a liquid crystal panel for displaying and setting image data and various functions.

The controller unit 300 totally controls each of these components.

The reader unit 200 includes a document feed unit 250 for conveying a document, and a scanner unit 210 for optically reading a document image and converting it into image data as an electrical signal. A printing unit 100 includes a printer unit 110 including a sheet cassette for storing sheets (also referred to as paper, printing sheets, and recording sheets) and a unit for transferring and fixing an image generated based on image data, and a finishing unit 401 for applying sorting processing and stapling processing to sheets with the image printed thereon.

The controller unit 300 controls the reader unit 200 to read an image of a document, and controls the printing unit 100 to output image data on a sheet. The controller unit 300 further converts the image read from the reader unit 200 into code data, and performs a scanner job for transmitting the code data to the host computers 501 and 502 via the LAN 500. The controller unit 300 further converts code data received from the host computers 501 and 502 via the LAN 500 into image data, and executes a print job for outputting the code data to the printing unit 100.

Figure 2:
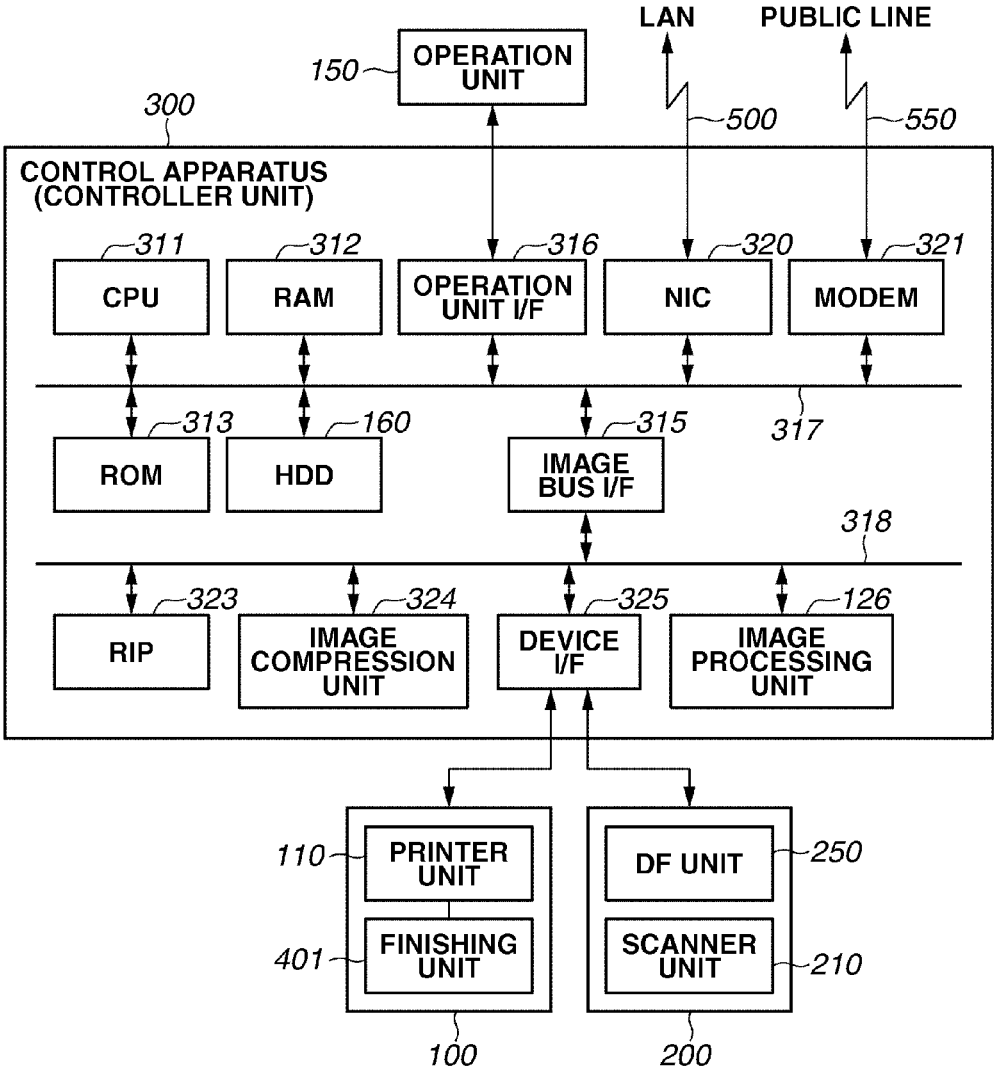
FIG. 2 is a block diagram illustrating a detailed configuration of a control apparatus illustrated in FIG. 1.

FIG. 2 is a block diagram illustrating a detailed configuration of the control apparatus (controller unit) 300 illustrated in FIG. 1.

Referring to FIG. 2, the controller unit 300 includes a central processing unit (CPU) 311, a random access memory (RAM) 312, a read-only memory (ROM) 313, a hard disk drive (HDD) 160, a control unit interface (I/F) 316, a network interface card (NIC) 320, a modulator/demodulator (modem) 321, and an image bus I/F 315. The controller unit 300 further includes a raster image processor (RIP) 323, an image compression unit 324, a device I/F 325, and an image processing unit 126.

The CPU 311 reads a program stored in the ROM 313 and the HDD 160 into the RAM 312, and executes the program to implement the functions described below.

The RAM 312 functions as a working area for the CPU 311. The RAM 312 also serves as an image memory for temporarily storing image data.

The ROM 313 stores various types of programs to be read by the CPU 311. The HDD 160 stores system software and image data. The operation unit I/F 316 functions as an interface unit with the operation unit 150, and outputs to the operation unit 150 image data to be displayed on the operation unit 150. The operation unit I/F 316 plays a role of transferring user-input information from the operation unit 150 to the CPU 311.

The network interface card (NIC) 320 is connected to the LAN 500 to input and output image data and apparatus information via the LAN 500. The modem 321 is connected to a public line 550 to input and output image data via the public line 550.

The above-described devices are disposed on a system bus 317. The image bus I/F 315 is a bus bridge for connecting between the system bus 317 and the image bus 318 which transmits image data at high speed. The image bus 318 is configured with the product configuration identification (PCI) bus or Institute of Electrical and Electronics Engineers (IEEE) 1394. The raster image processor (RIP) 323 rasterizes a page description language (PDL) code into a bitmap image. The image compression unit 324 compresses image data. For example, the image compression unit 324 compresses multivalued image data with Joint Photographic Experts Group (JPEG) and binary image data with Joint Bi-level Image Experts Group (JBIG), Modified READ (MMR), and Modified Huffman (MH).

The device I/F unit 325 connects the reader unit 200 (image input apparatus), the printing unit 100 (image output apparatus), and the controller unit 300. The image processing unit 326 corrects, processes, and edits image data.

Figure 3:
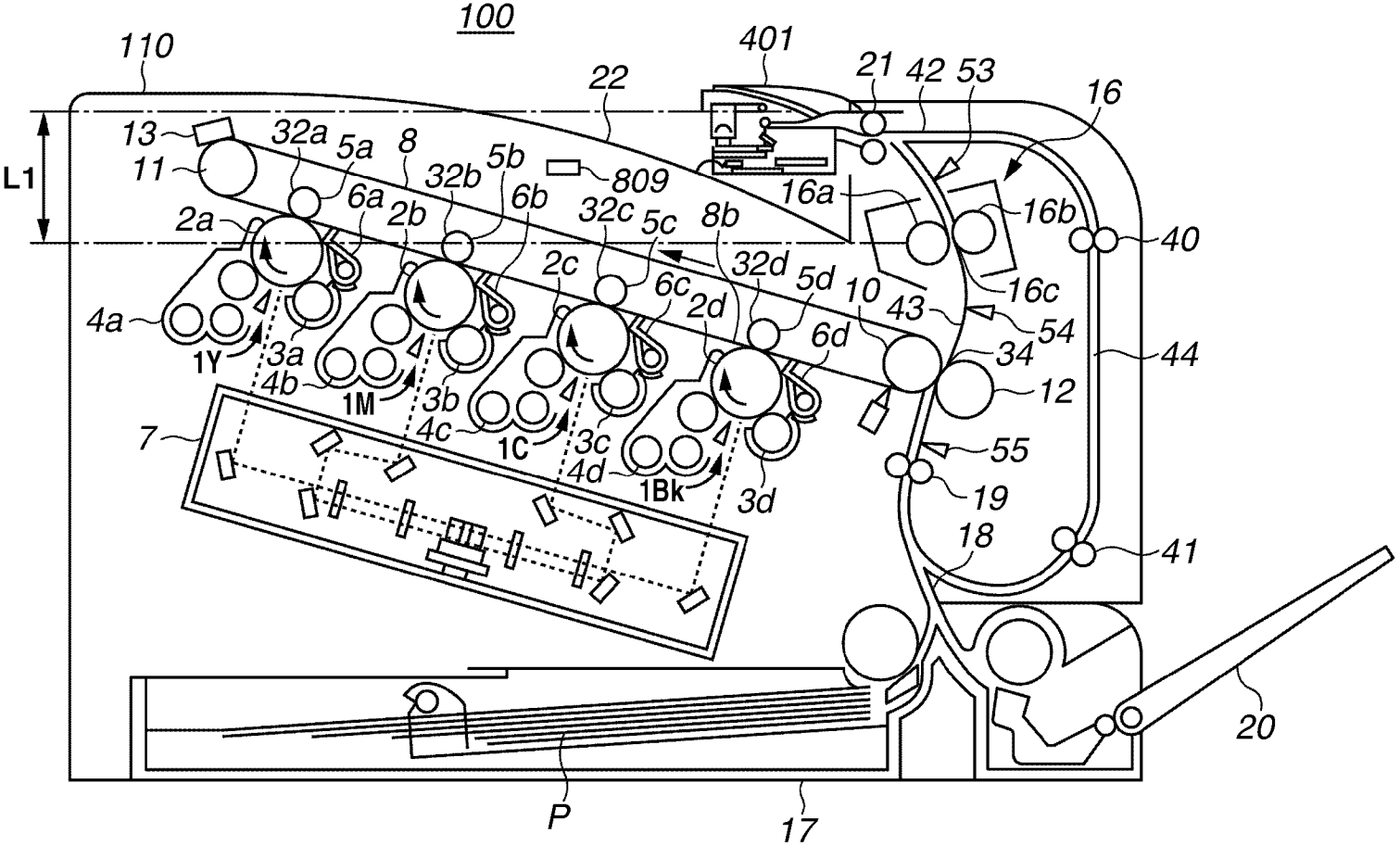
FIG. 3 is a cross sectional view illustrating a configuration of a printing apparatus according to an exemplary embodiment of the present invention.
Figure 4:
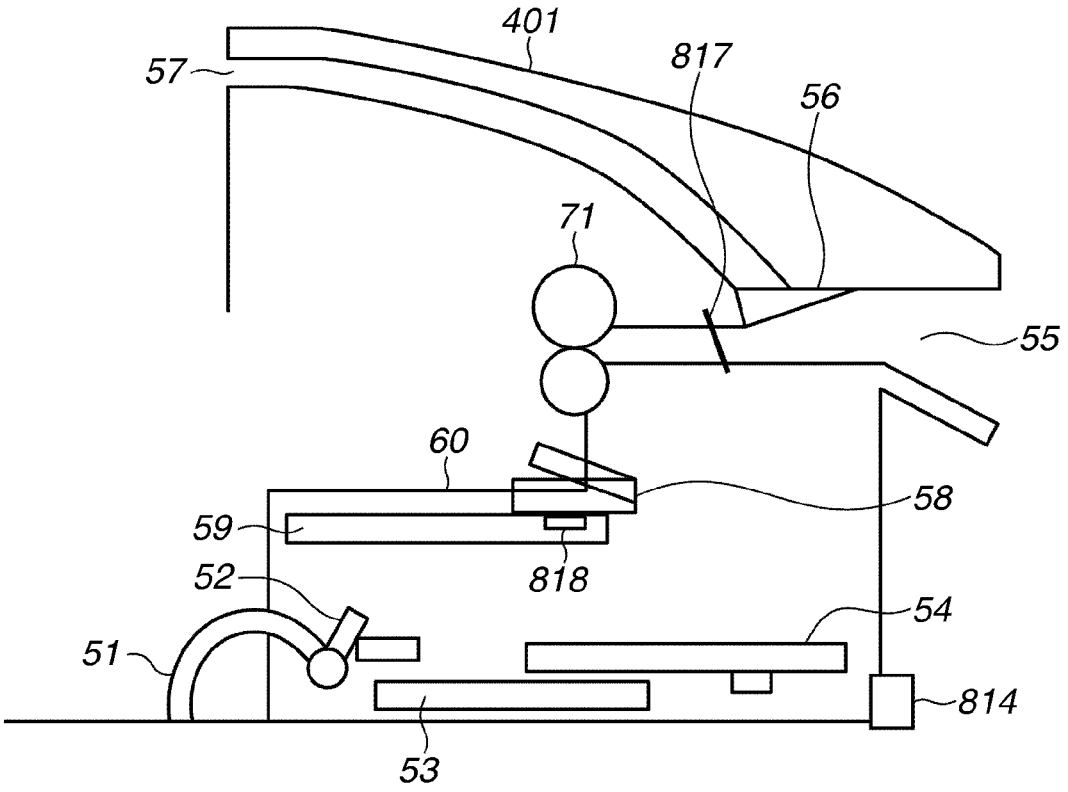
FIG. 4 is a cross sectional view illustrating a configuration of the printing apparatus according to an exemplary embodiment of the present invention.

The printer unit 110 will be described in detail below with reference to FIGS. 3 and 4. FIGS. 3 and 4 are cross sectional views illustrating a configuration of the printing apparatus 400 according to the present exemplary embodiment. FIG. 4 illustrates the finishing unit 401 provided at the sheet discharge port illustrated in FIG. 3. The finishing unit 401 is configured to perform stapling processing at a predetermined position of a sheet.

Referring to FIG. 3, the printing unit 100 includes four image forming units: an image formation unit 1Y for forming a yellow image, an image formation unit 1M for forming a magenta image, an image formation unit 1C for forming a cyan image, and an image formation unit 1Bk for forming a black image. The four image forming units 1Y, 1M, and 1C and 1Bk are disposed in a row at fixed intervals.

The image formation unit 1Y, 1M, and 1C and 1Bk respectively include photosensitive drums 2*a*, 2*b*, 2*c*, and 2*d* (image bearing members) having a drum shape.

Primary charging devices 3*a*, 3*b*, 3*c*, and 3*d*, developing devices 4*a*, 4*b*, 4*c*, and 4*d*, transfer rollers 5*a*, 5*b*, 5*c*, and 5*d* (transfer units), and drum cleaning devices 6*a*, 6*b*, 6*c*, and 6*d* are disposed around the photosensitive drums 2*a*, 2*b*, 2*c* and 2*d*, respectively.

A laser exposure device 7 is disposed below positions between the primary charging devices 3*a*, 3*b*, 3*c*, and 3*d* and the developing devices 4*a* 4*b* 4*c*, and 4*d*, respectively.

The developing devices 4*a*, 4*b*, 4*c*, and 4*d* store recording agents, such as yellow toner, cyan toner, magenta toner, and black toner, respectively.

Each of the photosensitive drums 2*a*, 2*b*, 2*c*, and 2*d* is a negatively charged organic photoconductor (OPC) photosensitive member composed of an aluminum base and a photosensitive layer formed thereon. The photosensitive drums 2*a*, 2*b*, 2*c*, and 2*d* are rotated in the clockwise direction at a predetermined process speed by a driving apparatus (not illustrated).

The primary charging devices 3*a*, 3*b*, 3*c*, and 3*d* (primary charging units) uniformly charges the surfaces of the photosensitive drums 2*a*, 2*b*, 2*c* and 2*d*, respectively, to a predetermined negative potential by using a charging bias voltage applied from a charging bias power supply (not illustrated).

The developing devices 4*a*, 4*b*, 4*c*, and 4*d* includes toner of respective colors, applies the toner to electrostatic latent images formed on the photosensitive drums 2*a*, 2*b*, and 2*c* and 2*d*, respectively, to develop visible toner images.

The transfer rollers 5*a*, 5*b*, 5*c*, and 5*d* (primarily transfer units) are disposed to contact the photosensitive drum 2*a*, 2*b*, 2*c*, and 2*d* via an intermediate transfer belt 8 (transfer unit), at primary transfer portions 32*a*, 32*b*, 32*c*, and 32*d*, respectively.

The drum cleaning devices 6*a*, 6*b*, 6*c*, and 6*d* remove from the photosensitive drums 2*a*, 2*b*, 2*c*, and 2*d* residual transfer toner remaining thereon, respectively, at the time of primary transfer.

The intermediate transfer belt 8 is disposed on the upper face side of the photosensitive drums 2*a*, 2*b*, 2*c*, and 2*d*, and stretched by a secondary transfer counter roller 10 and a tension roller 11. A secondary transfer counter roller 10 is disposed to contact a secondary transfer roller 12 via the intermediate transfer belt 8 at a secondary transfer portion 34. The intermediate transfer belt 8 is made of a dielectric resin, such as polycarbonate, a polyethylene terephthalate resin film, and a polyvinylidene fluoride resin film.

The intermediate transfer belt 8 is obliquely disposed in such away that a primary transfer surface 8*b* (flat surface of the lower portion) thereof formed on the side facing the photosensitive drums 2*a*, 2*b*, 2*c*, and 2*d* is arranged with the side of the secondary transfer roller 12 set lower than the other side.

More specifically, the intermediate transfer belt 8 is obliquely disposed in such a way that the primary transfer surface 8*b* movably disposed on the upper surfaces of the photosensitive drums 2*a*, 2*b*, 2*c*, and 2*d* and formed on the side facing the photosensitive drums 2 with the side of the secondary transfer portion 34 set lower than the other side.

Specifically, the angle of inclination is set to about 15 degrees. The intermediate transfer belt 8 is stretched by the secondary transfer counter roller 10 disposed on the side of the secondary transfer portion 34 to apply a driving force to the intermediate transfer belt 8 and the tension roller 11 disposed on the side facing the secondary transfer counter roller 10 via the primarily transferring portions 32*a* to 32*d* to apply tension to the intermediate transfer belt 8.

The secondary transfer counter roller 10 is disposed to contact the secondary transfer roller 12 at the secondary transfer portion 34 via the intermediate transfer belt 8. A belt cleaning device (not illustrated) for removing and collecting residual transfer toner remaining on the surface of the endless intermediate transfer belt 8 is disposed in the vicinity of the tension roller 11 outside the intermediate transfer belt 8.

A fixing device 16 including a fixing roller 16*a* and a pressure roller 16*b* is disposed on the downstream side of the secondary transfer portion 34 in the sheet conveyance direction.

The laser exposure device 7 is composed of a laser emitting unit for emitting light corresponding to supplied image information (a time series electrical digital pixel signal), a polygon lens, reflection mirrors, and so on. The laser exposure device 7 performs exposure of the photosensitive drum 2*a*, 2*b*, 2*c*, and 2*d* to form electrostatic latent images of respective colors according to the image information on the surfaces of the photosensitive drums 2*a*, 2*b*, 2*c*, and 2*d* charged by the primary charging devices 3*a*, 3*b*, 3*c*, and 3*d*, respectively.

The following describes image forming operations performed by the printing apparatus 400.

For example, when a print instruction is made by the host computer 501, the printing apparatus 502 performs the following control. The primary charging devices 3*a*, 3*b*, 3*c*, and 3*d* uniformly negatively charges the photosensitive drums 2*a*, 2*b*, 2*c*, and 2*d* of the image formation units 1Y, 1M, and 1C and 1Bk, respectively, rotating at predetermined process speed.

In the laser exposure device 7, the laser emitting unit emits laser light based on a color separation image signal input from outside. The laser light passes through a polygon lens, reflection mirrors, etc., and scans the surfaces of the photosensitive drums 2*a*, 2*b*, 2*c*, and 2*d* to form electrostatic latent images of respective colors.

First of all, the developing device 4*a*, to which a developing bias voltage having the same polarity as the charged polarity (negative polarity) of the photosensitive drum 2*a* is applied, applies yellow toner to the electrostatic latent image formed on the photosensitive drum 2*a* to form a visible toner image.

The transfer roller 5*a*, to which a primarily transfer bias voltage having the opposite polarity (positive polarity) to the toner polarity is applied, primarily transfers the yellow toner image onto the intermediate transfer belt 8 at the primarily transferring portion 32*a* between the photosensitive drum 2*a* and the transfer roller 5*a*.

The intermediate transfer belt 8 with the yellow toner image transferred thereon is moved to the image formation unit 1M. Likewise, the image formation unit 1M transfers onto the intermediate transfer belt 8 a magenta toner image formed on the photosensitive drum 2*b* so that the magenta toner image is placed on top of the yellow toner image at the primarily transfer portion 32*b*.

Likewise, the image formation units 1C and 1Bk transfer onto the intermediate transfer belt 8 cyan and black toner images formed on the photosensitive drums 2*c* and 2*d*, respectively, so that the cyan and black toner images are placed on top of the magenta and cyan toner images at the primarily transfer portions 32*c* and 32*d*, respectively. Thus, a full color toner image is formed on the intermediate transfer belt 8. Then, cleaner blades included in the drum cleaning devices 6*a*, 6*b*, 6*c*, and 6*d* remove residual transfer toner remaining on respective photosensitive drums 2*a*, 2*b*, 2*c*, and 2*d*, respectively.

Then, in synchronization with a timing when the leading edge of the full color toner image on the intermediate transfer belt 8 reaches the secondary transfer portion 34 between the secondary transfer counter roller 10 and the secondary transfer roller 12, a registration roller pair 19 conveys a recording sheet to the secondary transfer portion 34. The sheet is selected from a sheet cassette 17 or a manual feed tray 20, and then conveyed via a conveyance path 18. In the present exemplary embodiment, a conveyance path from the registration roller pair 19 to a discharge roller pair 21 is referred to a one-sided conveyance path for convenience of description.

The secondary transfer roller 12, to which the secondary transfer bias voltage having the opposite polarity (positive polarity) to the toner polarity is applied, collectively secondarily transfers the full color toner image onto the sheet conveyed to the secondary transfer portion 34.

When the sheet with the full color toner image transferred thereon is conveyed to the fixing device 16, the fixing device 16 heats and pressurizes the full color toner image at a fixing nip portion 31 between the fixing roller 16*a* and the pressure roller 16*b* to fix the toner image onto the surface of the sheet. Then, the sheet is fed to a post-processing apparatus 33 (described below) by the discharge roller pair 21 and then discharged onto a discharge tray 22 at the top surface of the post-processing apparatus 33. This completes a series of image forming operations. A fixing motor 50 drives the discharge roller pair 21.

The belt cleaning device removes and collects secondary residual transfer toner remaining on the intermediate transfer belt 8.

Figure 5:
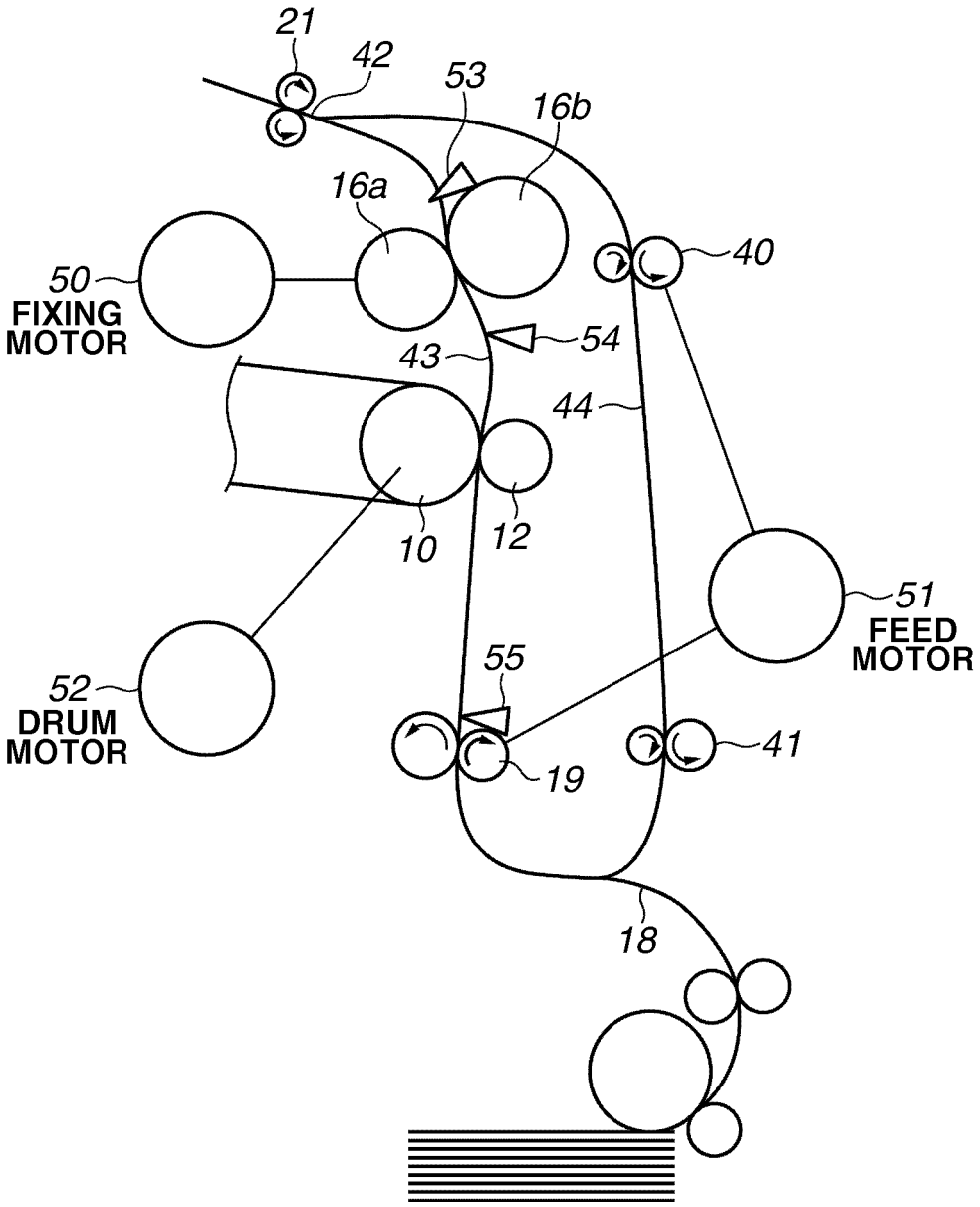
FIG. 5 is a cross sectional view illustrating a configuration of the printing apparatus according to an exemplary embodiment of the present invention.

The configuration of the finishing unit 401 (illustrated in FIG. 4) will be described in detail below with reference to FIG. 5. In the present exemplary embodiment, the finishing unit 401 is configured as a stapler. Referring to FIG. 5, the finishing unit 401 for performing post-processing at the time of sheet discharge is provided with a sheet entering portion 55 to enable the discharge roller pair 21 to feed the sheet into the finishing unit 401. To receive and convey the sheet from the printer unit 110, the finishing unit 401 takes synchronization by communicating with the printer unit 110 via the printing apparatus engine I/F unit 814. Then, the finishing unit 401 detects that the sheet has been conveyed from the sheet entering portion 55 via a sheet detection sensor 817. The sheet conveyed from the sheet entering portion 55 is discharged into a bundle tray 60 by a forwardly rotating conveyance roller 71. The conveyance roller 71 is driven by a driving force of a motor of the printer unit 110. A clutch configuration (not illustrated) enables the conveyance roller 71 to rotate in the forward and reverse rotational directions.

With sheets discharged onto the bundle tray 60 and temporarily stacked in the bundle tray 60, a sorting member (not illustrated) horizontally shifts the sheets in the discharge direction. This processing is referred to as sorting processing.

The finishing unit 401 shifts the sheets conveyed from the sheet entering portion 55 in units of a predetermined number of sheets in the sorting direction, and, after a predetermined number of sheets have been stacked, performs the stapling processing by using a stapler 58 as required. Then, a bungle output slider included in the stapler 58 slides to discharge the stacked sheets onto the discharge tray 22.

The bundle tray 60 is provided with a sheet detection sensor 818 which notifies the printer unit 110 of whether sheets are stacked in the bundle tray 60 via a printing apparatus engine I/F unit 814.

In the subsequent description, as illustrated in FIG. 5, the sheet discharge direction refers to a direction in which the sheet is conveyed by the discharge roller pair 21 rotating in the direction indicated by the arrows, and the sheet reversing direction refers to the direction in which the sheet is conveyed by the discharge roller pair 21 rotating in the direction opposite to the direction indicated by the arrows. The sheet conveyance direction refers to the direction in which the sheet is conveyed by the registration roller pair 19 and the two-sided roller pairs 40 and 41 rotating in the directions indicated by the arrows. The printer unit 110 is configured to, even in a state where a sheet P remains over the discharge roller pair 21 and the two-sided roller pairs 40 and 41, pull out the sheet P by rotating the two-sided roller pairs 40 and 41 driven by a feed motor 51.

The following describes a relation between a stapling position specification and sheet conveyance control in a case where the finishing unit 401 is a finisher having an unmovable stapler (a stapler fixed to one position), with reference to FIG. 6. The following example will be described based on single-sided printing.

FIG. 6 illustrates a relation between a stapling position specification and sheet conveyance control of the printing apparatus according to the present exemplary embodiment.

Referring to FIG. 6, a stapling position can be selected from the four corners: "UPPER LEFT", "LOWER LEFT", "UPPER RIGHT", and "LOWER RIGHT" of the sheet P. The stapling position of the finishing unit 401 is fixed to the "LOWER LEFT" position described in FIG. 6. The orientation of a letter "F" indicates the orientation of the image to be printed on the sheet P. A letter "F" deeply illustrated indicates a face-up output (the printed side is face up), and a letter "F" faintly illustrated indicates a face-down output (the printed side is face down).

When the stapling position specification is "NONE", the CPU 311 conveys the sheet P in the one-sided conveyance path 43, fixes the image onto the sheet P via the fixing device 16, and discharges the sheet P without stapling.

When the stapling position specification is "UPPER LEFT" and the sheet orientation is "PORTRAIT", the CPU 311 conveys the sheet Pin the one-sided conveyance path 43, rotates the image by 180 degrees with respect to the image orientation that is set when the stapling position specification is "NONE", and fixes the image onto the sheet P via the fixing device 16. Then, the finishing unit 401 applies stapling to the sheets P to enable providing a print product stapled at the "UPPER LEFT" corner. When the sheet orientation is "LANDSCAPE", the CPU 311 prints input images from the last page (reverse printing). The CPU 311 conveys the sheet P in the one-sided conveyance path 43, and fixes the image onto the sheet P via the fixing device 16. Then, the CPU 311 conveys the sheet P in a two-sided conveyance path 44, and reverses the sheet P. Finally, the finishing unit 401 applies stapling to the sheets P to enable providing a print product stapled at the "UPPER LEFT" corner.

When the stapling position specification is "LOWER LEFT" and the sheet orientation is "PORTRAIT", the CPU 311 prints input images from the last page (reverse printing). The CPU 311 conveys the sheet P in the one-sided conveyance path 43, rotates the image by 180 degrees with respect to the image orientation that is set when the stapling position specification is "NONE", and fixes the image onto the sheet P via the fixing device 16. Then, the CPU 311 conveys the sheet P in the two-sided conveyance path 44, and reverses the sheet P.

Finally, the finishing unit 401 applies stapling to the sheets P to enable providing a print product stapled at the "LOWER LEFT" corner. When the sheet orientation is "LANDSCAPE", the CPU 311 conveys the sheet P in the one-sided conveyance path 43, rotates the image by 180 degrees with respect to the image orientation that is set when the stapling position specification is "NONE", and fixes the image onto the sheet P via the fixing device 16. Then, the finishing unit 401 applies stapling to the sheets P to enable providing a print product stapled at the "LOWER LEFT" corner.

When the stapling position specification is "UPPER RIGHT" and the sheet orientation is "PORTRAIT", the CPU 311 prints input images from the last page (reverse printing). The CPU 311 conveys the sheet P in the one-sided conveyance path 43, and fixes the image onto the sheet P via the fixing device 16. Then, the CPU 311 conveys the sheet P in the two-sided conveyance path 44, and reverses the sheet P. Finally, the finishing unit 401 applies stapling to the sheets P to enable providing a print product stapled at the "UPPER RIGHT" corner. When the sheet orientation is "LANDSCAPE", the CPU 311 conveys the sheet P in the one-sided conveyance path 43, and fixes the image onto the sheet P via the fixing device 16. Then, the finishing unit 401 applies stapling to the sheets P to enable providing a print product stapled at the "UPPER RIGHT" corner.

When the stapling position specification is "LOWER RIGHT" and the sheet orientation is "PORTRAIT", the CPU 311 conveys the sheet P in the one-sided conveyance path 43, and fixes the image onto the sheet P via the fixing device 16. Then, the finishing unit 401 applies stapling to the sheets P to enable providing a print product stapled at the "LOWER RIGHT" corner. When the sheet orientation is "LANDSCAPE", the CPU 311 prints input images from the last page (reverse printing). The CPU 311 conveys the sheet P in the one-sided conveyance path 43, rotates the image by 180 degrees with respect to the image orientation that is set when the stapling position specification is "NONE", and fixes the image via the fixing device 16. Then, the CPU 311 conveys the sheet P in the two-sided conveyance path 44, and reverses the sheet P. Finally, the finishing unit 401 applies stapling to the sheets P to enable providing a print product stapled at the "LOWER RIGHT" corner.

The above-described control is implemented when the CPU 311 of the controller unit 300 sequentially reads a relevant program stored in the ROM 313 and the HDD 160 into the RAM 312, and executes the program.

Figure 7:
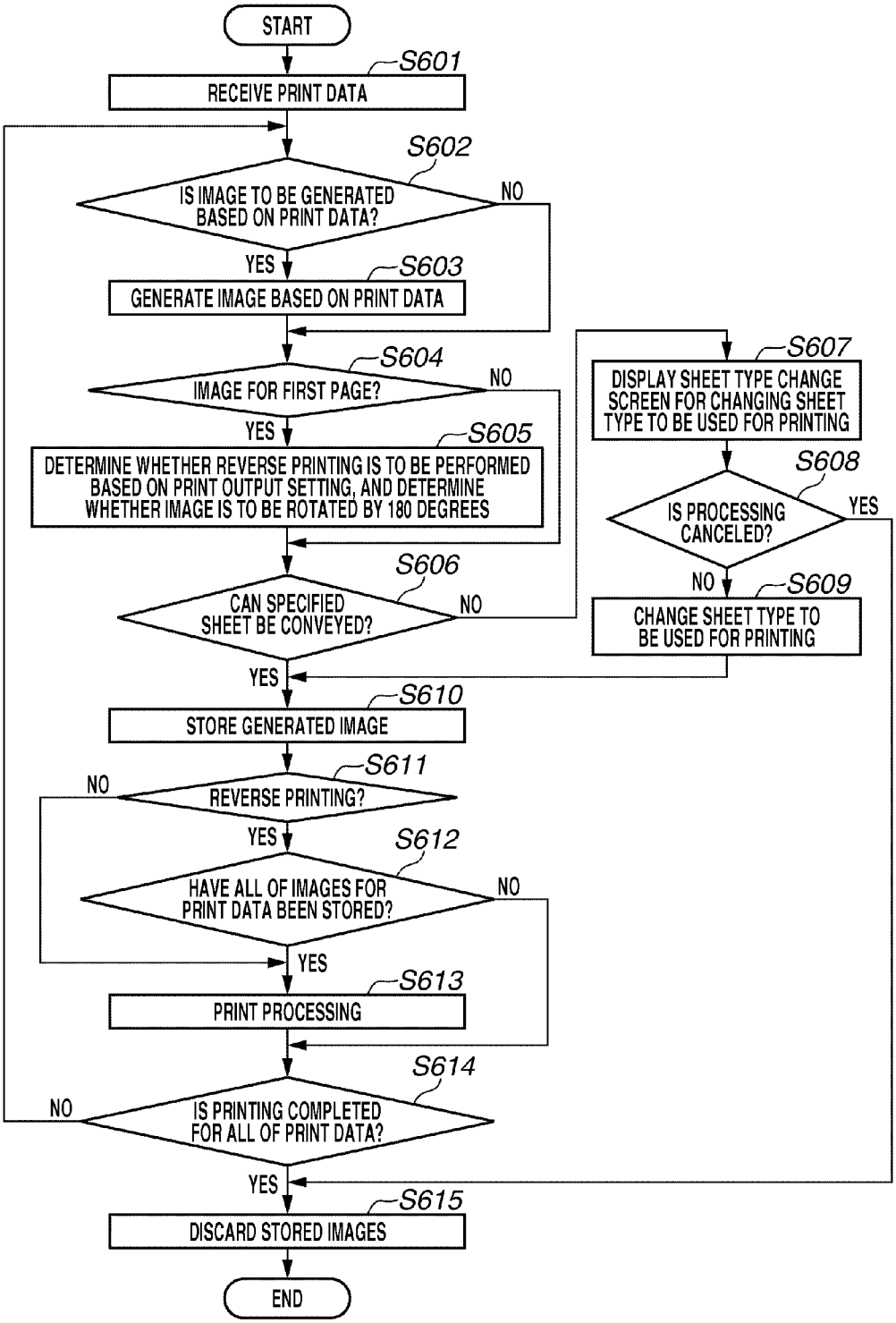
FIG. 7 is a flowchart illustrating a method for controlling the printing apparatus.

The following describes stapling printing control according to the present exemplary embodiment with reference to the flowchart illustrated in FIG. 7. FIG. 7 is a flowchart illustrating a method for controlling the printing apparatus according to the present exemplary embodiment. Staple printing control will be described in detail below. Each step in the flowchart is controlled when the CPU 311 of the controller unit 300 reads a relevant program stored in the ROM 313 and the HDD 160 into the RAM 312, and executes the program.

In step S601, the CPU 311 receives print data (print information) including print setting information transmitted from the host PC 501 or 502 via the NIC 320. In step S602, the CPU 311 determines whether it is necessary to generate an image based on the received print data, more specifically, whether any image for the print data has not yet been generated. The above-described print setting information includes the sheet setting information for specifying the sheet type to be used and the sheet orientation.

When the CPU 311 determines that a certain image has not yet been generated for the print data (YES in step S602), then in step S603, the CPU 311 controls the RIP 323 to generate the relevant image based on the print data. The generated image data may be stored in the RAM 312 or the HDD 160. The CPU 311 generates an image based on the setting included in the print data (such as reduction layout, bookbinding, one-sided printing, two-sided printing, portrait printing, landscape printing, and stapling position) and the setting in the printing apparatus 400 (such as confidential printing and 2-color mode). Stapling positions specifiable by the user includes upper left, lower left, upper right, and lower right.

The print data further includes the output setting (for example, sheet feed stages, output sheet size, output sheet type, and finishing information, such as sorting, grouping, punching, and stapling). Otherwise, when the CPU 311 determines that all of images for the print data have been generated (NO in step S602), the processing proceeds to step S604.

In step S604, the CPU 311 determines whether the generated image is for the first page. When the CPU 311 determines that the generated image is for the first page (YES in step S604), the processing proceeds to step S605. Otherwise, when the CPU 311 determines that the generated image is not for the first page (NO in step S604), the processing proceeds to step S606.

In step S605, the CPU 311 determines which of forward printing and reverse printing is to be performed based on the stapling position and printing sheet orientation (portrait printing or landscape printing) settings included in the above-described output setting. In forward printing, printing is made from the first page in order of image generation. In reverse printing, printing is made from the last page in reverse order of image generation.

In step S606, the CPU 311 determines whether the specified sheet type is conveyable based on the information about forward printing or reverse printing determined in step S605 and the sheet information for the page of the generated image, because of the following reason. When the CPU 311 conveys a sheet in the two-sided conveyance path 44, the effect of rollers may crease the sheet, break the sheet during conveyance, or damage the sheet surface, depending on the sheet type. Therefore, the CPU 311 prestores in the HDD 160 the sheet type and information about whether the relevant sheet type is adversely affected when conveyed in the two-sided conveyance path 44. Then, based on the information stored in the HDD 160, the CPU 311 determines whether the sheet specified in the print data is adversely affected as described above when conveyed in the two-sided conveyance path 44. Sheet types which may be adversely affected when conveyed in the two-sided conveyance path 44 include thick paper, coated paper, and carbonless paper. The CPU 311 registers in the HDD 160 a flag for indicating effect by associating these sheet types with identification codes. This flag allows the CPU 311 to determine whether each sheet type specified in the relevant print data will be adversely affected when each sheet needs to be conveyed in the two-sided conveyance path 44 by the stapling position specification (described below).

When the CPU 311 determines that the specified sheet type is conveyable (YES in step S606), the processing proceeds to step S610. Otherwise, when the CPU 311 determines that the specified sheet type is unconveyable (NO in step S606), then in step S607, the CPU 311 displays on the operation unit 150 a SELECT SHEET TYPE screen 700 (illustrated in FIG. 8) for changing the sheet type subjected to printing, and receives a sheet change operation from the user.

Figure 8:
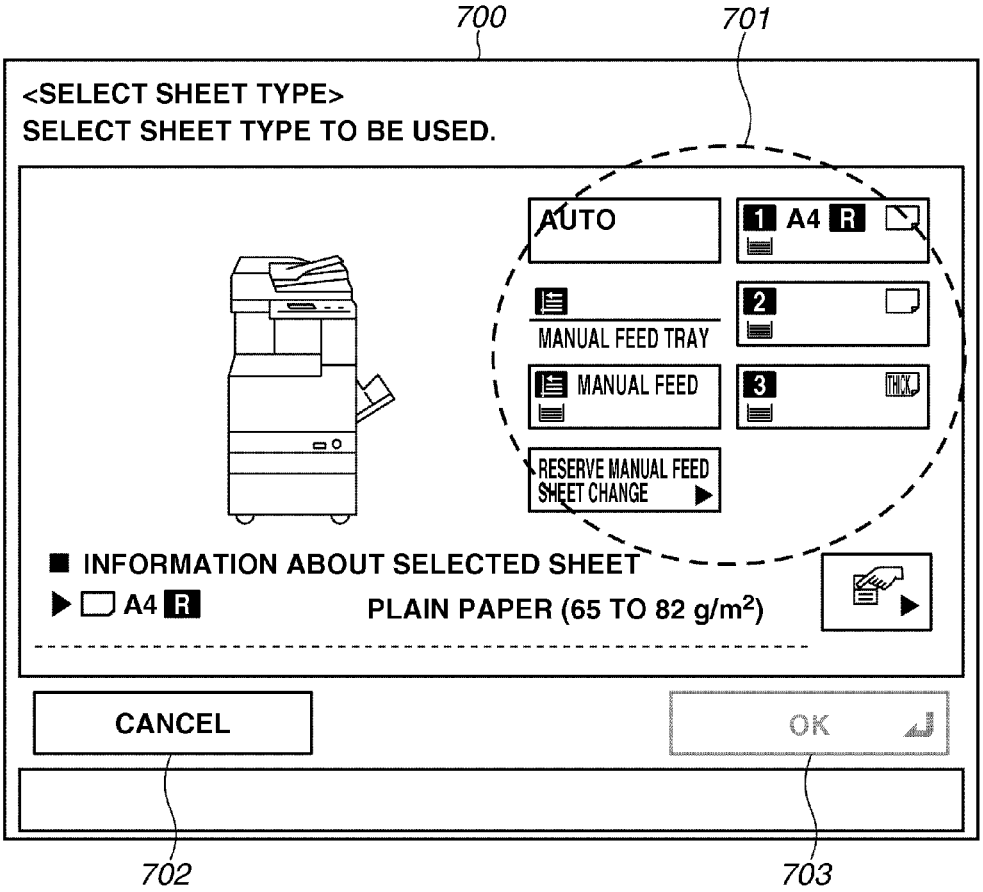
FIG. 8 illustrates an example user interface (UI) screen of the printing apparatus.

The SELECT SHEET TYPE screen 700 illustrated in FIG. 8 includes a plurality of sheet feed stage selection buttons 701 for selecting the sheet cassette 17 of the printing apparatus 400, a CANCEL button 702 for canceling processing, and an OK button 703 for continuing processing based on the changed setting.

For the selectable sheet feed stages associated with the sheet feed stage selection buttons 701, sheet information, such as the sheet size and sheet type set in the sheet feed stages of the printing apparatus 400, is also stored. This allows the user to select only a sheet feed stage in which a conveyable sheet type is set.

When the user selects any one of the sheet feed stage selection buttons 701 to select a cassette sheet feed stage or manual sheet feed stage in which a sheet type subjected to printing is set, and then presses the OK button 703, the sheet type can be changed.

In step S608, the CPU 311 determines whether the user has pressed the CANCEL button 702 in the SELECT SHEET TYPE screen 700 illustrated in FIG. 8. When the CPU 311 determines that the user has pressed the CANCEL button 702 (YES in step S608), then in step S615, the CPU 311 discards images that have been stored in the HDD 160 (an image storage unit of the printing apparatus 400), and the processing exits this flowchart.

Otherwise, when the CPU 311 determines that the user has pressed the OK button 703 in the SELECT SHEET TYPE screen 700 illustrated in FIG. 8 (NO in step S608), then in step S609, the CPU 311 reflects the change to the print output setting included in the print data by using the SELECT SHEET TYPE screen 700 for changing the sheet type subjected to printing, thus changing the sheet type subjected to printing. When the CPU 311 determines that the sheet type specified in the print data is thick paper and reverse printing is required, the CPU 311 prompts the user to change the sheet type from "THICK PAPER" to "PLAIN PAPER" in the SELECT SHEET TYPE screen 700. This enables preventing thick paper from being conveyed in the two-sided conveyance path 44 and creased.

In step S610, the CPU 311 stores in the HDD 160 (an image storage unit of the printing apparatus 400) the image generated in step S603. In step S611, the CPU 311 determines whether reverse printing was determined in step S605. When the CPU 311 determines that reverse printing was determined (YES in step S611), the processing proceeds to step S612. Otherwise, when the CPU determines that reverse printing was not determined (NO in step S611), then in step S613, the CPU 311 performs the print processing. The CPU 311 determines reverse printing or forward printing based on the relation between the stapling position and the image printing orientation illustrated in FIG. 6.

In step S612, the CPU 311 determines whether all of images for the print data have been generated and stored in the HDD 160. When the CPU 311 determines that all of images for the print data have been generated and stored in the HDD 160 (YES in step S612), then in step S613, the CPU 311 performs the print processing. At this timing, the CPU 311 applies 180-degree rotation processing to relevant images.

In the print processing in step S613, the CPU 311 also performs the stapling processing based on the print output setting. Otherwise, when the CPU 311 determines that not all of images for the print data have been generated and stored in the HDD 160 (NO in step S612), the processing proceeds to step S614.

In step S614, the CPU 311 determines whether printing is completed for all of the print data received in step S601. When the CPU 311 determines that printing is completed not for all of the print data (NO in step S614), the processing returns to step S602, and the CPU 311 repeats relevant processing.

Otherwise, when the CPU 311 determines that printing is completed for all of the print data (YES in step S614), then in step S615, the CPU 311 discards images stored in the HDD 160 (image storage unit of the printing apparatus 400), and the processing exits this flowchart.

Performing the above-described control enables changing a sheet type unconveyable in the two-sided conveyance path 44 to a conveyable sheet type at the time of reverse printing in stapling control. Thus, stapling processing can be applied to a user-specified position. Further, the possibility of paper jam can be reduced, improving user convenience.

According to the present exemplary embodiment, a method is described to detect the setting of a sheet type which should not be conveyed in the printing apparatus 400, notify the user of the fact, and change the sheet type to a conveyable sheet type. However, the printer drivers (not illustrated) on the host PCs 501 and 502 may acquire the sheet information about the currently conveyable sheet type from the printing apparatus 400, and generate print data. According to the present exemplary embodiment, the printing apparatus 400 is described to be based on a print job for receiving print data including the print setting information transmitted from the host PC 501 or 502, and generating and printing image data. However, the present exemplary embodiment is not limited to a print job, and may be applied to a copy job for reading a document image via the reader unit 200, and printing the image on a sheet via the printing unit 100. In step S601, the CPU 311 reads an image of the document via the reader unit 200. In steps S603 and S610, the CPU 311 stores in the HDD 160 the image of the document read via the reader unit 200.

Staple printing control according to the present exemplary embodiment has specifically been described with reference to FIG. 7. When performing reverse printing, the CPU 311 stores all of images for the print data in the HDD 160 (an image storage unit of the printing apparatus 400). However, not all of images for the print data can be stored in the HDD 160 because of insufficient capacity thereof. The following describes stapling printing control according to the capacity of the HDD 160, with reference to FIG. 9.

Figure 9:
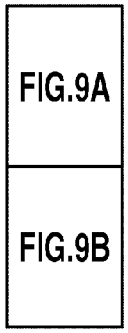
FIG. 9, which is composed of FIGS. 9A and 9B, is a flowchart illustrating a method for controlling the printing apparatus.
Figure 9A:
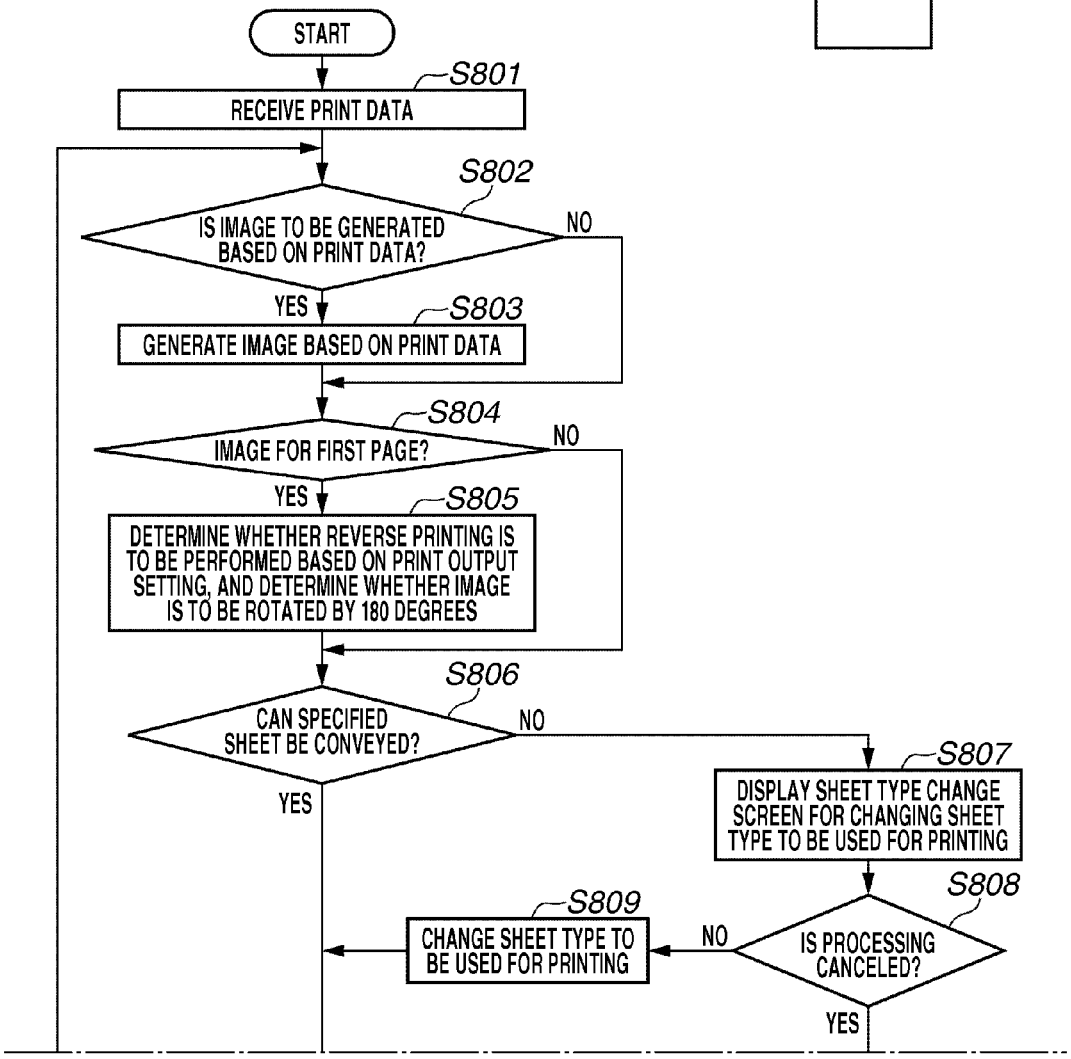
Figure 9B:
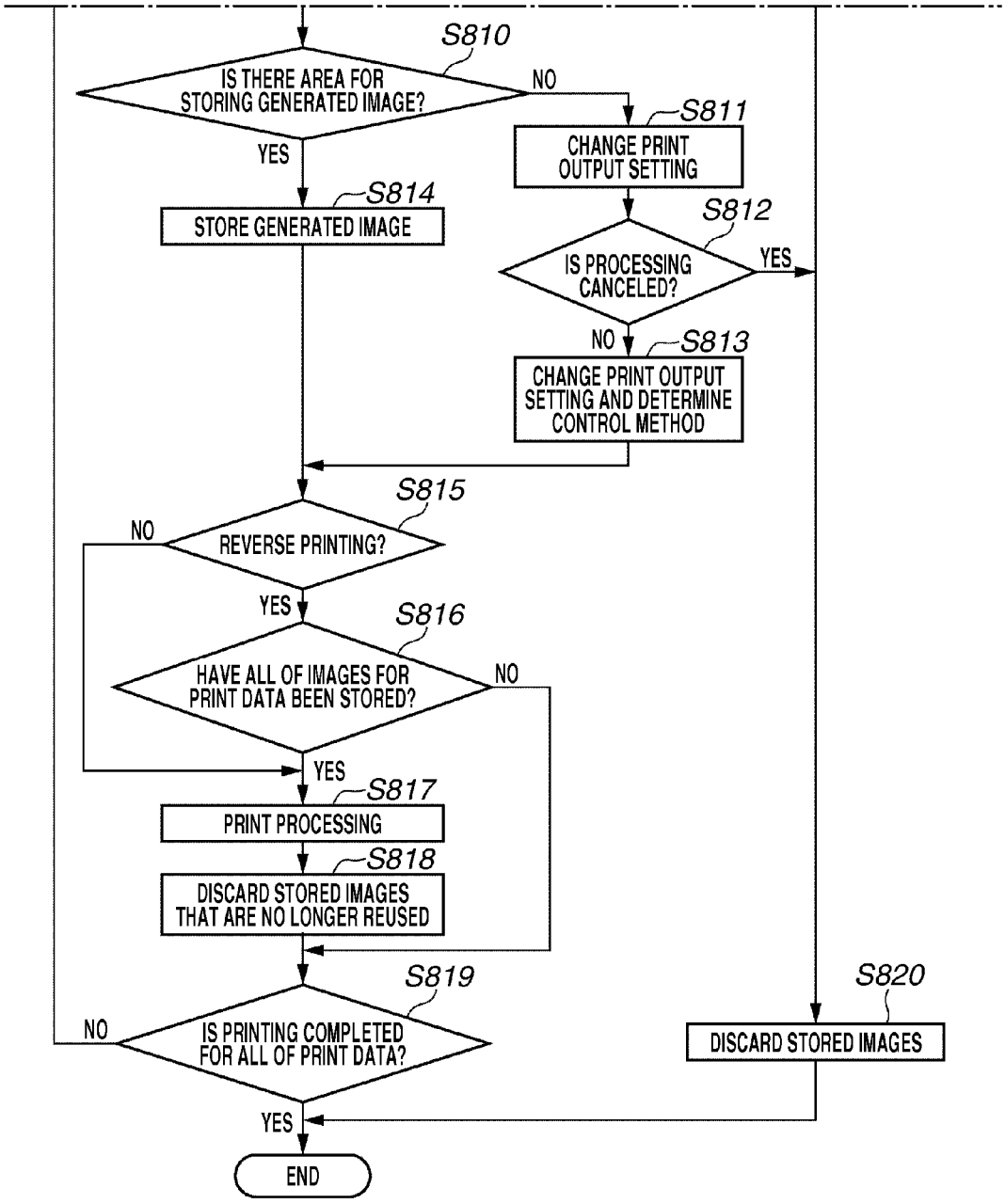

FIG. 9, which is composed of FIGS. 9A and 9B, is a flowchart illustrating a method for controlling the printing apparatus 400 according to the present exemplary embodiment. Staple printing control will be described in detail below. Each step in the flowchart is controlled when the CPU 311 of the controller unit 300 reads a relevant program stored in the ROM 313 and the HDD 160 into the RAM 312, and executes the program.

In step S801, the controller unit 300 receives print data including the print setting information transmitted from the host PCs 501 and 502 via the NIC 320. In step S802, the CPU 311 determines whether it is necessary to generate an image based on the received print data, more specifically, whether any image for the print data has not yet been generated, based on the control program to be executed. The above-described print setting information includes the sheet setting information for specifying the sheet type to be used and the sheet orientation.

When the CPU 311 determines that a certain image for the print data has not yet been generated (YES in step S802), then in step S803, the CPU 311 generates the relevant image based on the print data. The CPU 311 generates an image based on the setting included in the print data (such as reduction layout, bookbinding, one-sided printing, two-sided printing, portrait printing, and landscape printing) and the setting in the printing apparatus 400 (such as confidential printing and 2-color mode). The print data further includes the output setting (for example, sheet feed stages, sheet size, sheet type, and finishing information, such as sorting, grouping, punching, and stapling).

Otherwise, when the CPU 311 determines that an image is not to be generated (NO in step S802), the processing proceeds to step S804. This case includes a case when an image is currently being processed, for example, an image has already been generated but has not yet been stored in the HDD 160 in step S814, and a case when all of images for the print data have been generated.

In step S804, the CPU 311 determines the generated image is for the first page. When the CPU 311 determines that the image is for the first page (YES in step S804), then in step S805, the CPU 311 determines which of forward printing and reverse printing is to be performed, and determines whether 180-degree rotation processing is to be applied to relevant images, based on the setting of the stapling position and sheet orientation (portrait printing or landscape printing). Otherwise, when the CPU 311 determines that the image is not for the first page (NO in step S804), the processing proceeds to step S806.

In step S806, the CPU 311 determines whether the specified sheet type is conveyable in the one-sided conveyance path 43 or the two-sided conveyance path 44 based on the forward printing or reverse printing control information determined in step S805 and the sheet information of the page for the generated image determined in step S809. When the CPU 311 determines that the sheet type is conveyable (YES in step S806), the processing proceeds to step S810. Otherwise, when the CPU 311 determines that the sheet is unconveyable (NO in step S806), then in step S807, the CPU 311 displays the SELECT SHEET TYPE screen 700 (illustrated in FIG. 8) for changing the sheet type corresponding to the sheet type subjected to printing, and prompts the user to change the sheet type.

The SELECT SHEET TYPE screen 700 illustrated in FIG. 8 includes the plurality of sheet feed stage selection buttons 701 for selecting the sheet cassette 17 of the printing apparatus 400, a CANCEL button 702 for canceling processing, and an OK button 703 for continuing processing based on the changed setting.

For the selectable sheet feed stages displayed with the plurality of sheet feed stage selection buttons 701, sheet information, such as size and type of the sheet type set in the sheet feed stages of the printing apparatus 400, is also stored. This allows the user to select only a sheet feed stage where a conveyable sheet type is set.

When the user selects any one of the sheet feed stage selection buttons 701 to select a cassette sheet feed stage or manual sheet feed stage in which a sheet type subjected to printing is set, and then presses the OK button 703, the sheet type can be changed.

In step S808, the CPU 311 determines whether the user has pressed the CANCEL button 702 in the SELECT SHEET TYPE screen 700 illustrated in FIG. 8. When the CPU 311 determines that the user has pressed the CANCEL button 702 (YES in step S808), then in step S820, the CPU 311 discards images that have been stored in the HDD 160 (an image storage unit of the printing apparatus 400), and the processing exits this flowchart.

Otherwise, when the CPU 311 determines that the user has pressed the OK button 703 in the SELECT SHEET TYPE screen 700 (illustrated in FIG. 8) for changing the sheet type subjected to printing (NO in step S808), then in step S809, the CPU 311 reflects the setting changed in the SELECT SHEET TYPE screen 700 to the print output setting included in the print data to change the sheet type subjected to printing. When the CPU 311 determines that the sheet type specified in the print data is "THICK PAPER" and reverse printing is required, the CPU 311 prompts the user to change the sheet type from "THICK PAPER" to "PLAIN PAPER" in the SELECT SHEET TYPE screen 700. This enables preventing the sheet from being creased even with reverse printing.

In step S810, the CPU 311 determines whether there is an area in the HDD 160 (an image storage unit of the printing apparatus 400) for storing the image loaded on the RAM 312 in step S803. When the CPU 311 determines that there is an area in the HDD 160 for storing the image (YES in step S810), then in step S814, the CPU 311 stores in the HDD 160 (an image storage unit of the printing apparatus 400) the image loaded on the RAM 312 in step S803.

Figure 10A:
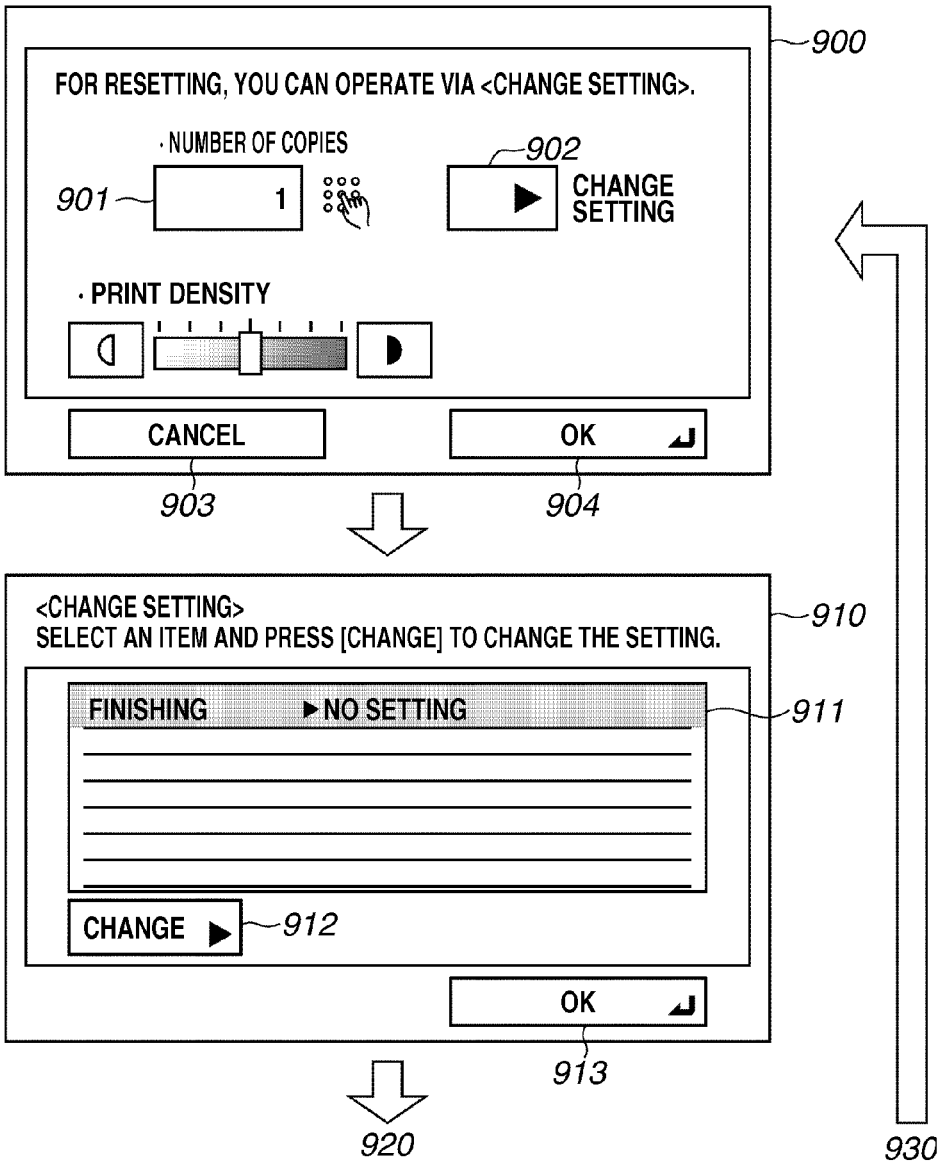
FIGS. 10A and 10B illustrate example UI screens of the printing apparatus.

Otherwise, when the CPU 311 determines that there is no area or there is not a sufficient area in the HDD 160 for storing the image (NO in step S810), then in step S811, the CPU 311 displays the output setting screen 900 illustrated in FIG. 10A on the operation unit 150, and receives a changed stapling setting (print output setting) from the user, since reverse printing and control of a plurality of copies are not possible.

The output setting screen 900 includes an NUMBER OF COPIES setting box 901 for changing the number of copies to be output, a CHANGE SETTING button 902 for displaying a CHANGE SETTING screen 910 displaying a list of changeable print settings, a CANCEL button 903 for canceling processing, and an OK button 904 for continuing processing based on the changed setting. In this case, the NUMBER OF COPIES setting box 901 in the output setting screen 900 is set to 1 since electronic sorting multiple copy output (in which images are stored in the HDD 160 of the printing apparatus 400 and printing is performed a plurality of number of times) is not possible.

When the user presses the CHANGE SETTING button 902 in the output setting screen 900, the CPU 311 displays the CHANGE SETTING screen 910 on the operation unit 150.

The CHANGE SETTING screen 910 includes a setting item list 911 displaying a list of changeable setting items, a CHANGE button 912 for proceeding to the CHANGE SETTING screen 910 for a setting item selected from the setting item list 911, and an OK button 913 for returning to the output setting screen 900. In the present exemplary embodiment, when the user selects "FINISHING" from the setting item list 911 and then presses the CHANGE button 912 intending to change the stapling setting, the CPU 311 displays a FINISHING screen 920 on the operation unit 150.

The FINISHING screen 920 includes a CANCEL SETTING button 922 for canceling the finishing setting, and a STAPLING button 921 for changing the stapling setting. When the user presses a BACK button 923 for returning to the FINISHING screen 920, the CPU 311 redisplays the previous screen (the CHANGE SETTING screen 910). The user selects a finishing type and then presses a NEXT button 924. Then, the CPU 311 displays a SET STAPLING POSITION screen 930 on the operation unit 150.

The SET STAPLING POSITION screen 930 includes stapling position setting buttons 931 (UPPER LEFT, LOWER LEFT, UPPER RIGHT, and LOWER RIGHT) for selecting a stapling position, and a CANCEL SETTING button 932 for canceling the stapling setting.

The SET STAPLING POSITION screen 930 further includes a BACK button 933 for returning to the previous screen (the FINISHING screen 920), and an OK button 934 for applying the setting and returning to the output setting screen 900. Based on the relation between the stapling position specification and sheet conveyance control illustrated in FIG. 6, the CPU 311 performs control to enable selecting a staplable position in forward printing control by using the stapling position setting buttons 931 in the SET STAPLING POSITION screen 930. When the user has changed the stapling position and then presses the OK button 934, the CPU 311 redisplays the output setting screen 900 on the operation unit 150.

In step S812, the CPU 311 determines whether the user has pressed the CANCEL button 903 in the output setting screen 900 illustrated in FIG. 10A. When the CPU 311 determines that the user has pressed the CANCEL button 903 (YES in step S812), then in step S820, the CPU 311 discards images that have been stored in the HDD 160 (an image storage unit of the printing apparatus 400), and the processing exits this flowchart.

Otherwise, when the CPU 311 determines that the user has pressed the OK button 904 in the output setting screen 900 illustrated in FIG. 10A (NO in step S812), then in step S813, the CPU 311 reflects the setting changed in the SET STAPLING POSITION screen 930 to the print output setting included in the print data, and determines which of forward printing and reverse printing is to be performed.

In step S814, the CPU 311 stores in the HDD 160 (an image storage unit of the printing apparatus 400) the image loaded on the RAM 312 in step S803. In step S815, based on the information illustrated in FIG. 6, the CPU 311 determines whether the printing method determined in step S805 or S813 is reverse printing. When the CPU 311 determines that reverse printing is to be performed (YES in step S815), the processing proceeds to step S816. Otherwise, when the CPU 311 determines that reverse printing is not to be performed (NO in step S815), then in step S817, the CPU 311 performs the print processing.

In step S816, the CPU 311 determines whether all of images for the print data have been generated and stored in the HDD 160. When the CPU 311 determines that all of images for the print data have been generated and stored in the HDD 160 (YES in step S816), then in step S817, the CPU 311 performs the print processing. At this timing, the CPU 311 also applies 180-degree rotation processing to relevant images.

In the print processing in step S817, the CPU 311 also performs the stapling processing based on the print output setting. Otherwise, when the CPU 311 determines that not all of images for the print data have been generated and stored in the HDD 160 (NO in step S816), the processing proceeds to step S819.

In step S818, the CPU 311 discards from the HDD 160 images that have been printed and no longer reused. Discarding images that have been no longer reused in step S818 enables allocating an area for storing new images.

In step S819, the CPU 311 determines whether printing is completed for all of the print data received in step S801. When the CPU 311 determines that printing is not completed (NO in step S819), the processing returns to step S802, and the CPU 311 repeats relevant processing. Otherwise, when the CPU 311 determines that printing is completed (YES in step S819), the processing exits this flowchart.

With the above-described control, even if there is not a sufficient area in the HDD 160 for storing images in stapling control according to the present exemplary embodiment, printing can be continued by changing the stapling position related to the print output setting and finishing setting so that not all of images need to be stored. Specifically, the CPU 311 changes the stapling position setting to specify a stapling position not requiring reverse printing.

Figure 11:
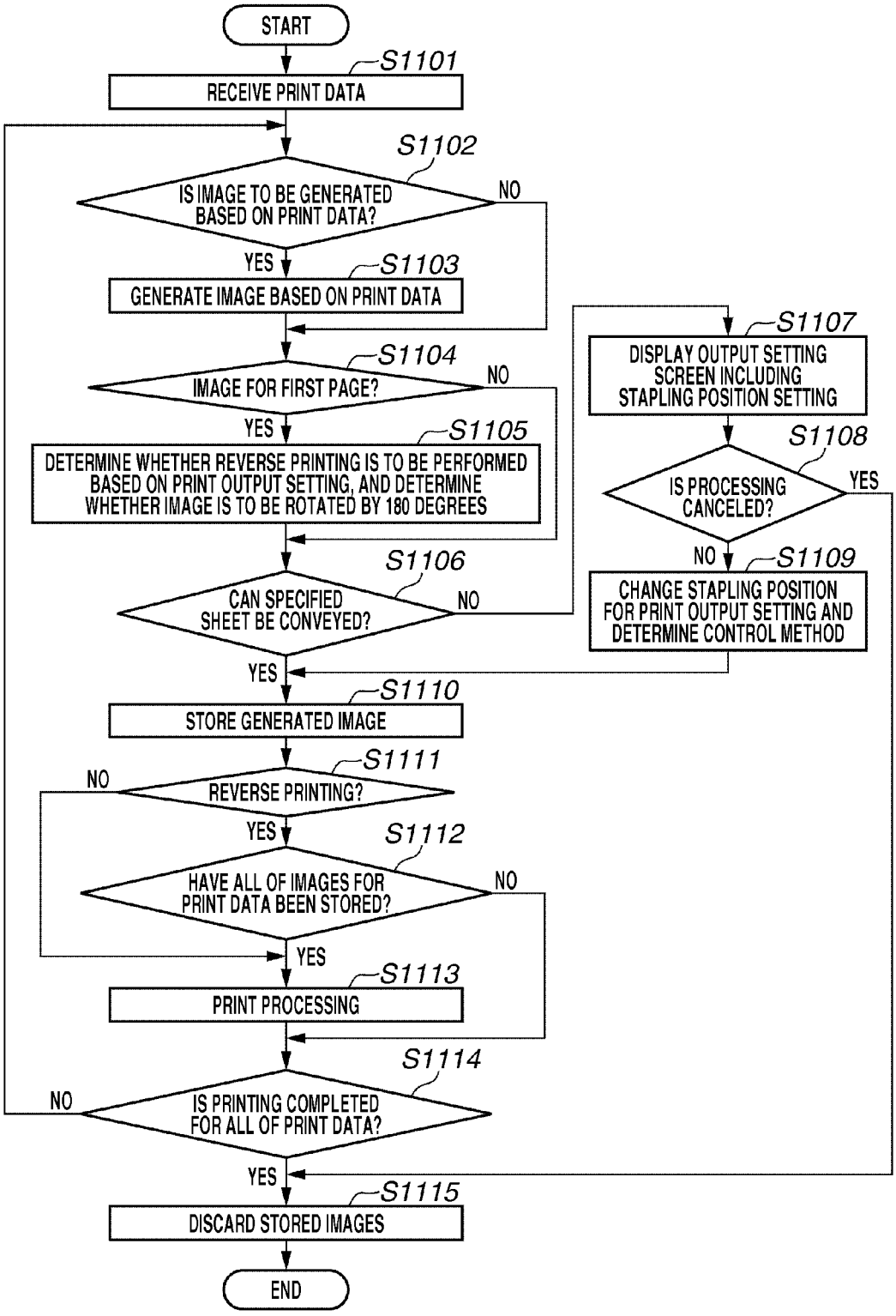
FIG. 11 is a flowchart illustrating a method for controlling a printing apparatus.

FIG. 11 is a flowchart illustrating a method for controlling a printing apparatus according to a second exemplary embodiment of the present invention. Staple printing control will be described in detail below. Steps in the flowchart are controlled when the CPU 311 of the controller unit 300 sequentially reads relevant programs stored in the ROM 313 and the HDD 160 into the RAM. 312, and executes the programs.

In step S1101, the controller unit 300 receives print data including the print setting information transmitted from the host PCs 501 and 502 via the NIC 320. In step S1102, the CPU 311 determines whether it is necessary to generate an image based on the received print data, more specifically, whether any image for the print data has not yet been generated, based on the control program to be executed. When the CPU 311 determines that a certain image for the print data has not yet been generated (YES in step S1102), then in step S1103, the CPU 311 controls the RIP 323 to generate the relevant image based on the print data on the RAM 312. The above-described print setting information includes the sheet setting information for specifying the sheet type to be used and the sheet orientation.

The CPU 311 generates an image based on the setting included in the print data (such as reduction layout, bookbinding, one-sided printing, two-sided printing, portrait printing, and landscape printing) and the setting in the printing apparatus 400 (such as confidential printing and 2-color mode).

The print data further includes the output setting (for example, sheet feed stages, sheet size, sheet type, and finishing information, such as sorting, grouping, punching, and stapling).

Otherwise, when the CPU 311 determines that all of images for the print data have been generated (NO in step S1102), then in step S1104, the CPU 311 determines whether the generated image is for the first page. This is because some PDL print data items allow print output setting for each page.

When the CPU 311 determines that the generated image is for the first page (YES in step S1104), then in step S1105, the CPU 311 determines which of forward printing and reverse printing is to be performed based on the setting of the stapling position and sheet orientation (portrait printing or landscape printing), and determines whether 180-degree rotation processing is to be applied to relevant images.

Otherwise, when the generated image is not for the first page (NO in step S1104), then in step S1106, the CPU 311 determines whether the specified sheet type is conveyable in the one-sided conveyance path 43 and the two-sided conveyance path 44 based on the information about forward printing or reverse printing determined in step S1105 and the sheet information for the page of the generated image. When the CPU 311 determines that the sheet type is conveyable (YES in step S1106), the processing proceeds to step S1110.

Otherwise, when the CPU 311 determines that the specified sheet type is unconveyable (NO in step S1106), then in step S1107, the CPU 311 displays on the operation unit 150 the output setting screen 900 (illustrated in FIG. 10A) for setting the stapling position. Then, the CPU 311 receives a changed stapling setting (print output setting) from the user.

The output setting screen 900 includes the NUMBER OF COPIES setting box 901 for changing the number of copies to be output, the CHANGE SETTING button 902 for displaying the CHANGE SETTING screen 910, the CANCEL button 903 for canceling processing, and the OK button 904 for continuing processing based on the changed setting.

When the user presses the CHANGE SETTING button 902 in the output setting screen 900, the CPU 311 displays the CHANGE SETTING screen 910 on the operation unit 150. The CHANGE SETTING screen 910 includes the setting item list 911 displaying a list of changeable setting items, the CHANGE button 912 for proceeding to the CHANGE SETTING screen 910 for a setting item selected from the setting item list 911, and the OK button 913 for returning to the output setting screen 900. In the present exemplary embodiment, when the user selects a type of finishing from the setting item list 911 and then presses the CHANGE button 912 intending to change the stapling setting, the CPU 311 displays the FINISHING screen 920 on the operation unit 150.

The FINISHING screen 920 includes the CANCEL SETTING button 922 for canceling the finishing setting, and the STAPLING button 921 for changing the stapling setting. When the user presses the BACK button 923 in the FINISHING screen 920, the CPU 311 redisplays the previous screen (the CHANGE SETTING screen 910). When the user selects a finishing type and then presses the NEXT button 924, the CPU 311 displays the SET STAPLING POSITION screen 930 on the operation unit 150.

The SET STAPLING POSITION screen 930 includes the stapling position setting buttons 931 (UPPER LEFT, LOWER LEFT, UPPER RIGHT, and LOWER RIGHT) for selecting a stapling position, the CANCEL SETTING button 932 for canceling the stapling setting, the BACK button 933 for returning to the previous screen (the FINISHING screen 920), and the OK button 934 for applying the setting and returning to the output setting screen 900.

In the SET STAPLING POSITION screen 930, the CPU 311 performs control to allow the user to select a staplable position (any one of the stapling position setting buttons 931) in forward printing, based on the relation between the stapling position specification and sheet conveyance control illustrated in FIG. 6. When the user changes the stapling position and then presses the OK button 934, the CPU 311 redisplays the output setting screen 900 on the operation unit 150.

In step S1108, the CPU 311 determines whether the user has pressed the CANCEL button 903 in the output setting screen 900 illustrated in FIG. 10A. When the CPU 311 determines that the user has pressed the CANCEL button 903 (YES in step S1108), then in step S1115, the CPU 311 discards images that have been stored in the HDD 160 (an image storage unit of the printing apparatus 400), and the processing exits this flowchart.

Otherwise, when the CPU 311 determines that the user has pressed the OK button 904 illustrated in FIG. 10A (NO in step S1108), then in step S1109, the CPU 311 reflects the setting (stapling position) changed in the SET STAPLING POSITION screen 930 for setting the stapling position, to conform to the print output setting included in the print data. Then, the CPU 311 determines whether which of forward printing control and reverse printing control is to be performed, and determines whether 180-degree rotation processing is to be applied to relevant images.

In step S1110, the CPU 311 stores in the HDD 160 (an image storage unit of the printing apparatus 400) the image loaded on the RAM 312 in step S1103. In step S1111, the CPU 311 determines whether the control determined in steps S1105 and S1109 is reverse printing control. When the CPU 311 determines that reverse printing control is to be performed (YES in step S1111), the processing proceeds to step S1112. Otherwise, when reverse printing control is not to be performed (NO in step S1111), then in step S1113, the CPU 311 performs the print processing. At this timing, the CPU 311 applies 180-degree rotation processing to relevant images.

In step S1112, the CPU 311 determines whether all of images for the print data have been generated and stored in the HDD 160. When the CPU 311 determines that all of images for the print data have been generated and stored in the HDD 160 (YES in step S1112), then in step S1113, the CPU 311 performs the print processing. In the print processing in step S1113, the CPU 311 also performs the stapling processing based on the print output setting. Otherwise, when the CPU 311 determines that not all of images for the print data have been generated and stored in the HDD 160 (NO in step S1112), the processing proceeds to step S1114.

In step S1114, the CPU 311 determines whether printing is completed for all of the print data received in step S1101. When the CPU 311 determines that printing is completed not for all of the print data (NO in step S1114), the processing returns to step S1102, and the CPU 311 repeats relevant processing.

Otherwise, when the CPU 311 determines that printing is completed for all of the print data (YES in step S1114), then in step S1115, the CPU 311 discards images stored in the HDD 160 (an image storage unit of the printing apparatus 400), and the processing exits this flowchart.

With the above-described control, even if a sheet type unconveyable in the two-sided conveyance path 44 is set, forward printing not requiring sheet conveyance in the two-sided conveyance path 44 can be selected by changing the stapling setting. The CPU 311 not only cancels output processing but also notifies the user of an alternative method enabling stapling processing, improving user convenience.

In the present exemplary embodiment, the CPU 311 performs control, when it detects a setting of a sheet type which should not be conveyed in the printing apparatus 400, to prompt the user to change the stapling setting. The same effect will be obtained even when the printer drivers (not illustrated) on the host PCs 501 and 502 acquire the sheet information of the sheet cassette of the printing apparatus 400, and generate print data.

Staple printing control has specifically been described with reference to FIG. 11. Reverse printing becomes controllable when all of images for the print data have been stored in the HDD 160 (an image storage unit of the printing apparatus 400). However, not all of images for the print data can be stored because of an insufficient capacity of the HDD 160. Example processing for coping with this problem will be described below.

Figure 12:
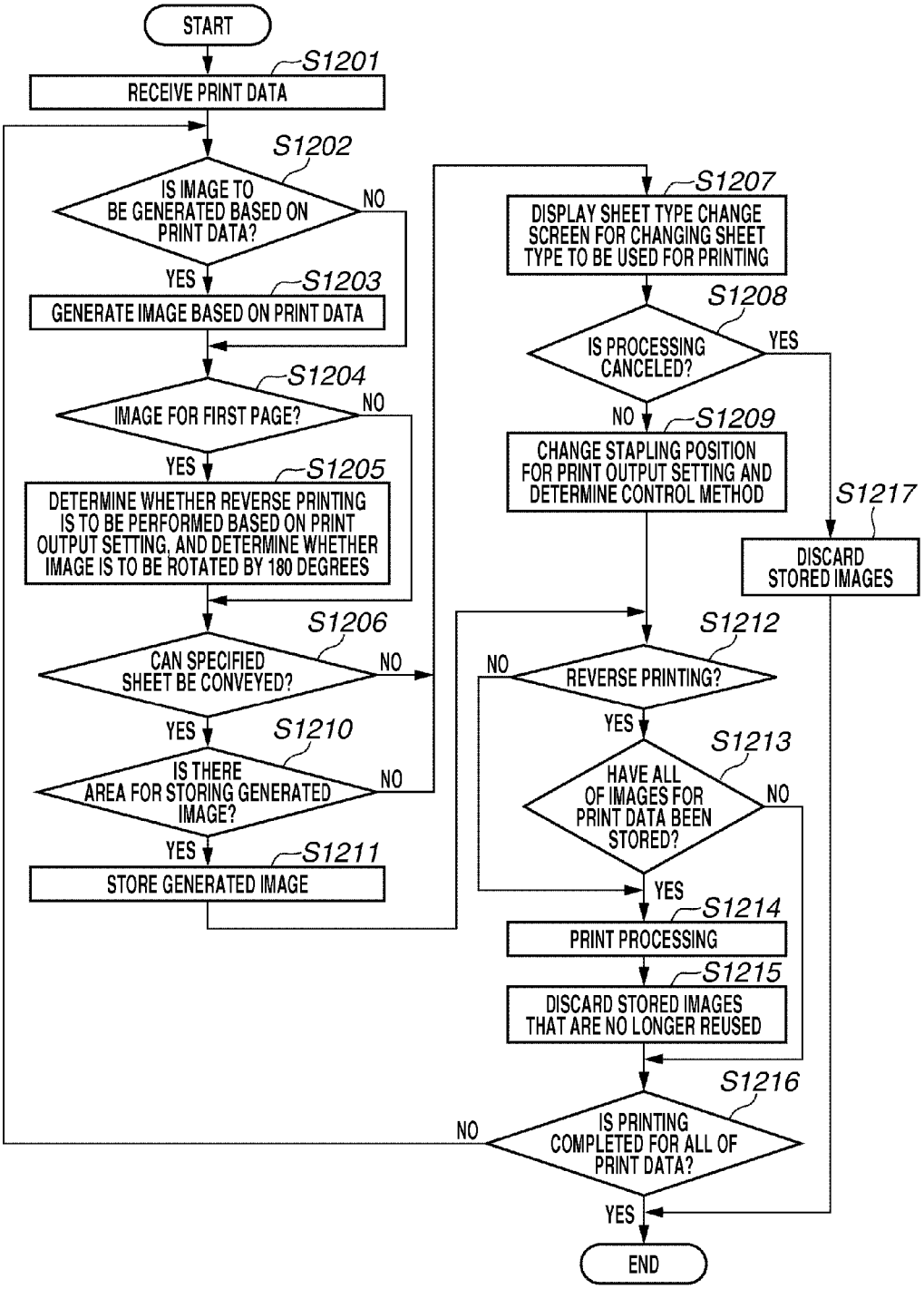
FIG. 12 is a flowchart illustrating a method for controlling the printing apparatus.

FIG. 12 is a flowchart illustrating a method for controlling the printing apparatus according to the present exemplary embodiment. Staple printing control will be described in detail below. Steps in the flowchart are controlled when the CPU 311 of the controller unit 300 sequentially reads relevant programs stored in the ROM 313 and the HDD 160 into the RAM 312, and executes the programs.

In step S1201, the controller unit 300 receives the print data including the print setting information transmitted from the host PCs 501 and 502 via the NIC 320. In step S1202, the CPU 311 determines whether it is necessary to generate an image based on the received print data, more specifically, whether any image for the print data has not yet been generated, based on the control program to be executed. When the CPU 311 determines that a certain image for the print data has not yet been generated (YES in step S1202), then in step S1203, the CPU 311 controls the RIP 323 to generate the relevant image based on the print data on the RAM 312. The above-described print setting information includes the sheet setting information for specifying the sheet type to be used and the sheet orientation.

The CPU 311 generates an image based on the setting included in the print data (such as reduction layout, bookbinding, one-sided printing, two-sided printing, portrait printing, and landscape printing) and the setting in the printing apparatus 400 (such as confidential printing and 2-color mode). The print data further includes the output setting (for example, sheet feed stages, sheet size, sheet type, and finishing information, such as sorting, grouping, punching, and stapling).

Otherwise, when the CPU 311 determines that an image is not to be generated (NO in step S1202), the processing proceeds to step S1204. This case includes a case when an image is currently being processed, for example, an image has already been generated but has not yet been stored in the HDD 160 in step S1211, and a case when all of images for the print data have been generated.

In step S1204, the CPU 311 determines whether the generated image is for the first page. This is because some PDL print data items allow print output setting for each page. When the CPU 311 determines that the generated image is for the first page (YES in step S1204), then in step S1205, the CPU 311 determines whether which of forward printing and reverse printing is to be performed based on the setting of the stapling position and sheet orientation (portrait printing or landscape printing).

Otherwise, when the CPU 311 determines that the generated image is for the first page (NO in step S1204), the processing proceeds to step S1206.

In step S1206, based on the information about forward printing or reverse printing determined in steps S1205 and S1209 and the sheet information for the page of the generated image, the CPU 311 determines whether the specified sheet type is conveyable in the one-sided conveyance path 43 and the two-sided conveyance path 44. When the CPU 311 determines that the sheet type is conveyable (YES in step S1206), the processing proceeds to step S1210.

Otherwise, when the CPU 311 determines that the sheet is unconveyable (NO in step S1206), then in step S1207, the CPU 311 displays the SELECT SHEET TYPE screen 700 (illustrated in FIG. 8) for setting the stapling position on the operation unit 150, and receives a changed stapling setting (print output setting).

The output setting screen 900 includes the NUMBER OF COPIES setting box 901 for changing the number of copies to be output, the CHANGE SETTING button 902 for displaying the CHANGE SETTING screen 910, the CANCEL button 903 for canceling processing, and the OK button 904 for continuing processing based on the changed setting.

When the user presses the CHANGE SETTING button 902 in the output setting screen 900, the CPU 311 displays the CHANGE SETTING screen 910 on the operation unit 150. The CHANGE SETTING screen 910 includes the setting item list 911 displaying a list of changeable setting items, the CHANGE button 912 for proceeding to the CHANGE SETTING screen 910 for a setting item selected from the setting item list 911, and the OK button 913 for returning to the output setting screen 900.

In the present exemplary embodiment, when the user selects a type of finishing from the setting item list 911 and then presses the CHANGE button 912 intending to change the stapling setting, the CPU 311 displays the FINISHING screen 920 on the operation unit 150. The FINISHING screen 920 includes the CANCEL SETTING button 922 for canceling the finishing setting, and the STAPLING button 921 for changing the stapling setting.

When the user presses the BACK button 923 in the FINISHING screen 920, the CPU 311 redisplays the previous screen (the CHANGE SETTING screen 910). When the user selects a finishing type and then presses the NEXT button 924, the CPU 311 displays the SET STAPLING POSITION screen 930 on the operation unit 150. The SET STAPLING POSITION screen 930 includes the stapling position setting buttons 931 for selecting a stapling position, the CANCEL SETTING button 932 for canceling the stapling setting, the BACK button 933 for returning to the previous screen (the FINISHING screen 920), and the OK button 934 for applying the setting and returning to the output setting screen 900. The CPU 311 performs control in the SET STAPLING POSITION screen 930 to allow the user to select a staplable position (any one of the stapling position setting buttons 931) in forward printing control based on the relation of the stapling position specification and conveyance control illustrated in FIG. 6. When the user changes the stapling position and then presses the OK button 934, the CPU 311 redisplays the output setting screen 900.

In step S1208, the CPU 311 determines whether the user has pressed the CANCEL button 903 in the output setting screen 900 illustrated in FIG. 10A. When the CPU 311 determines that the user has pressed the CANCEL button 903 (YES in step S1208), then in step S1217, the CPU 311 discards images that have been stored in the HDD 160 (an image storage unit of the printing apparatus 400), and the processing exits this flowchart.

Otherwise, when the CPU 311 determines that the user has pressed the OK button 904 in the output setting screen 900 illustrated in FIG. 10A (NO in step S1208), then in step S1209, the CPU 311 reflects the setting (stapling position) changed in the output setting screen 900 for setting the stapling position, to conform to the print output setting included in the print data. Then, the CPU 311 determines which of forward printing and reverse printing is to be performed, and determines whether 180-degree rotation processing is to be applied to relevant images.

In step S1210, the CPU 311 determines whether there is an area in the HDD 160 (an image storage unit of the printing apparatus 400) for storing the image loaded on the RAM 312 in step S1203. When the CPU 311 determines that there is an area for storing the image (YES in step S1210), then in step S1211, the CPU 311 stores in the HDD 160 (an image storage unit of the printing apparatus 400) the image loaded on the RAM 312 in step S1203. Otherwise, when the CPU 311 determines that there is no area for storing the image (NO in step S1210), then in step S1207, the CPU 311 changes the print output setting since reverse printing and control of a plurality of copies are not possible. In this case, the NUMBER OF COPIES setting box 901 in the output setting screen 900 is set to 1 since electronic sorting multiple copy output (in which images are stored in the HDD 160 of the printing apparatus 400 and printing is performed a plurality of number of times) is not possible.

In step S1211, the CPU 311 stores in the HDD 160 (an image storage unit of the printing apparatus 400) the image loaded on the RAM 312 in step S1203. In step S1212, based on the information indicating the relation between the stapling position and the sheet orientation illustrated in FIG. 6, the CPU 311 determines whether the control determined in steps S1205 and S1209 is reverse printing. When the CPU 311 determines that reverse printing is to be performed (YES in step S1212), the processing proceeds to step S1213. Otherwise, when the CPU 311 determines that reverse printing is not to be performed (NO in step S1212), then in step S1214, the CPU 311 performs the print processing.

In step S1213, the CPU 311 determines whether all of images for the print data have been generated and stored in the HDD 160. When the CPU 311 determines that all of images for the print data have been generated and stored in the HDD 160 (YES in step S1213), then in step S1214, the CPU 311 performs the print processing. At this timing, the CPU 311 also applies 180-degree rotation processing to relevant images.

In the print processing in step S1214, the CPU 311 also performs the stapling processing based on the print output setting. Otherwise, when the CPU 311 determines that not all of images for the print data have been generated and stored in the HDD 160 (NO in step S1213), the processing proceeds to step S1216.

In step S1215, the CPU 311 discards from the HDD 160 images that have been printed and no longer reused. Discarding images that have been no longer reused in this way enables allocating an area for storing new images.

In step S1216, the CPU 311 determines whether printing is completed for all of the print data received in step S1201. When the CPU 311 determines that printing is completed not for all of the print data (NO in step S1216), the processing returns to step S1202, and the CPU 311 repeats relevant processing. Otherwise, when the CPU 311 determines that printing is completed for all of the print data (YES in step S1216), the processing exits this flowchart.

With the above-described control, even if there is not a sufficient area in the HDD 160 for storing images in stapling control according to the present exemplary embodiment, printing can be continued by changing the stapling setting and the number of copies to be output. The CPU 311 not only cancels output processing but also notifies the user of an alternative method enabling stapling processing, improving user convenience.

According to the above-described exemplary embodiments, when reverse printing is to be performed in stapling control, a sheet type unconveyable in the two-sided conveyance path 44 can be changed to a conveyable sheet type. Thus, stapling processing can be reliably applied to a user-specified position. Further, since specification of an unconveyable sheet type can be avoided, the possibility of paper jam can be reduced, improving user convenience.

A print job is described to generate print data including the print setting information, such as stapling position, transmitted from the host PC 501 or 502, and generate and print image data, with reference to FIG. 11. In a third exemplary embodiment of the present invention, a copy job for printing via the printer unit 110 an image of a document read by the scanner unit 210 will be described below. In the case of a copy job, the user sets the print output and printing sheet by using the operation unit 150 of the printing apparatus 400. The controller unit 300 determines whether sheet conveyance for reversing the sheet is possible based on the information about the printing sheet type and whether the sheet is adversely affected by two-sided conveyance stored in the HDD 160 (described in the first exemplary embodiment). The following describes output setting control of a copy job with reference to FIG. 13.

Figure 13:
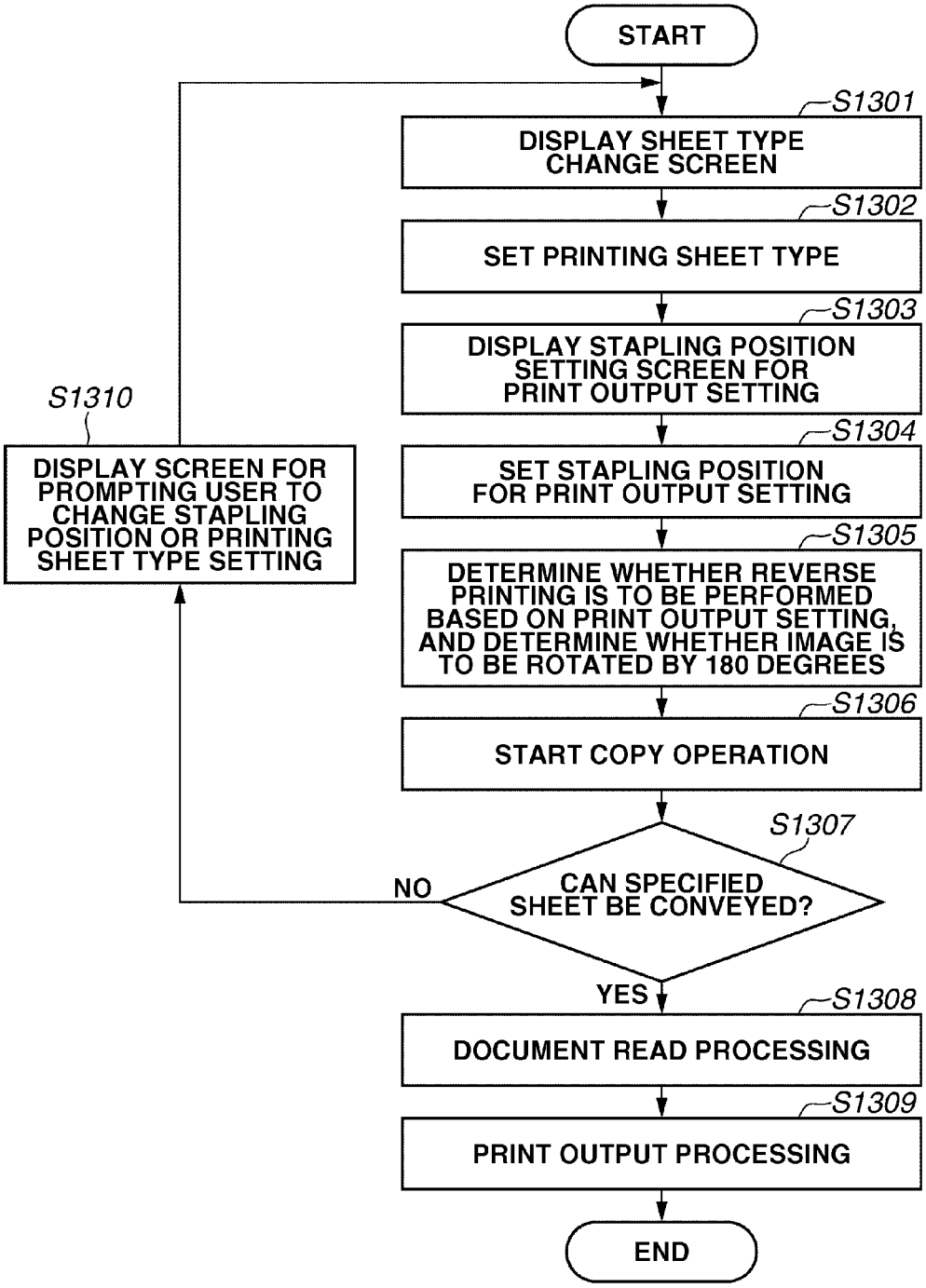
FIG. 13 is a flowchart illustrating a method for controlling a printing apparatus.

FIG. 13 is a flowchart illustrating a method for controlling a printing apparatus according to the third exemplary embodiment. The present exemplary embodiment is an example of output setting control of a copy job. Each step in the flowchart is controlled when the CPU 311 of the controller unit 300 reads a program stored in the ROM 313 or HDD 160 into the RAM 312, and then executes the program.

Figure 10B:
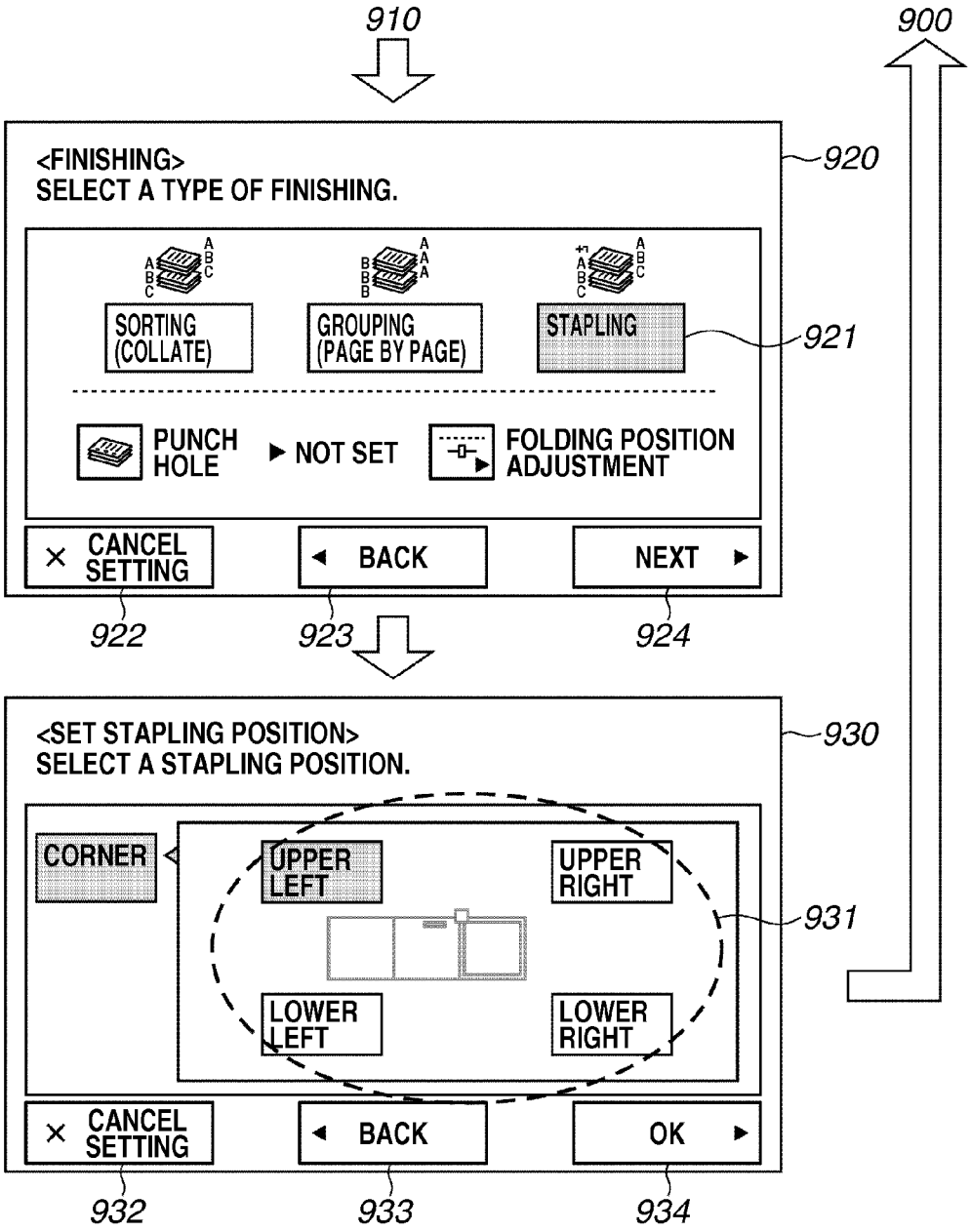

In step S1301, the CPU 311 displays the SELECT SHEET TYPE screen 700 (illustrated in FIG. 8) on the operation unit 150. In step S1302, the CPU 311 receives an operation instruction from the user, and sets the sheet type. In step S1303, the CPU 311 displays the print output setting screen 920 and the SET STAPLING POSITION screen 930 (illustrated in FIG. 10B) on the operation unit 150. At this timing, the SET STAPLING POSITION screen 930 displays a screen for allowing the user to set all of stapling positions processable by the finishing unit 401 regardless of the printing sheet type set in step S1302. In step S1304, the CPU 311 receives an operation instruction from the user, and sets the stapling position in the screen displayed in step S1303.

Although, in the present exemplary embodiment, the printing sheet type is set first and then print output setting is performed, it is also possible to perform print output setting first and then set the printing sheet type. Even if setting requiring two-sided conveyance is made in stapling position setting first, a printing sheet type unconveyable in the two-sided conveyance path 44 is selectable in the subsequent printing sheet setting screen.

In step S1305, based on the printing sheet type set in step S1302 and the information about the stapling position set in step S1304, the CPU 311 determines which of reverse printing and forward printing is to be performed, and determines whether 180-degree rotation processing is to be performed.

In step S1306, when the user sets a document on the document feed unit 250 and then presses a job start button (not illustrated) on the operation unit 150, the CPU 311 detects the press of the button, and instructs the controller unit 300 to start a copy operation. In step S1307, based on the information about the stapling position and printing sheet type set upon reception of a copy start instruction, the CPU 311 determines whether the specified sheet type is conveyable in the two-sided conveyance path 44 by using determination information recorded in the above-described HDD 160. When the CPU 311 determines that the sheet type is conveyable in the two-sided conveyance path 44 (YES in step S1307), then in step S1308, the CPU 311 performs document read processing. In step S1309, the CPU 311 executes a copy job such as print output processing.

Otherwise, when the CPU 311 determines that the sheet type is unconveyable in the two-sided conveyance path 44 (NO in step S1307), then in step S1310, the CPU 311 displays a screen for prompting the user to change the stapling position or printing sheet type, and the processing returns to step S1301. Not starting the copy job in this way enables preventing paper jam, improving user convenience.

In step S1308, upon reception of a read start instruction, the CPU 311 instructs the reader unit 200 to start reading the document. Then, the CPU 311 instructs the reader unit 200 to process image information of the read document to generate printable image data. In step S1309, the CPU 311 instructs the printing unit 100 to perform the print output processing for outputting the above-described image data to the selected sheet, and the processing exits this flowchart.

In the exemplary embodiment described with reference to FIG. 13, the CPU 311 of the controller unit 300 determines whether the specified sheet type is conveyable upon reception of a copy start instruction with the job start button (not illustrated) on the operation unit 150. However, it is possible to determine whether the specified sheet type is conveyable based on information about determined setting values immediately before displaying each screen for setting the stapling position and printing sheet type.

In a fourth exemplary embodiment of the present invention, the CPU 311 determines whether it is necessary to convey the printing sheet in the two-sided conveyance path 44 based on the set stapling position, and prevents a sheet type unconveyable in the two-sided conveyance path 44 from being selected in the sheet setting screen.

Figure 14:
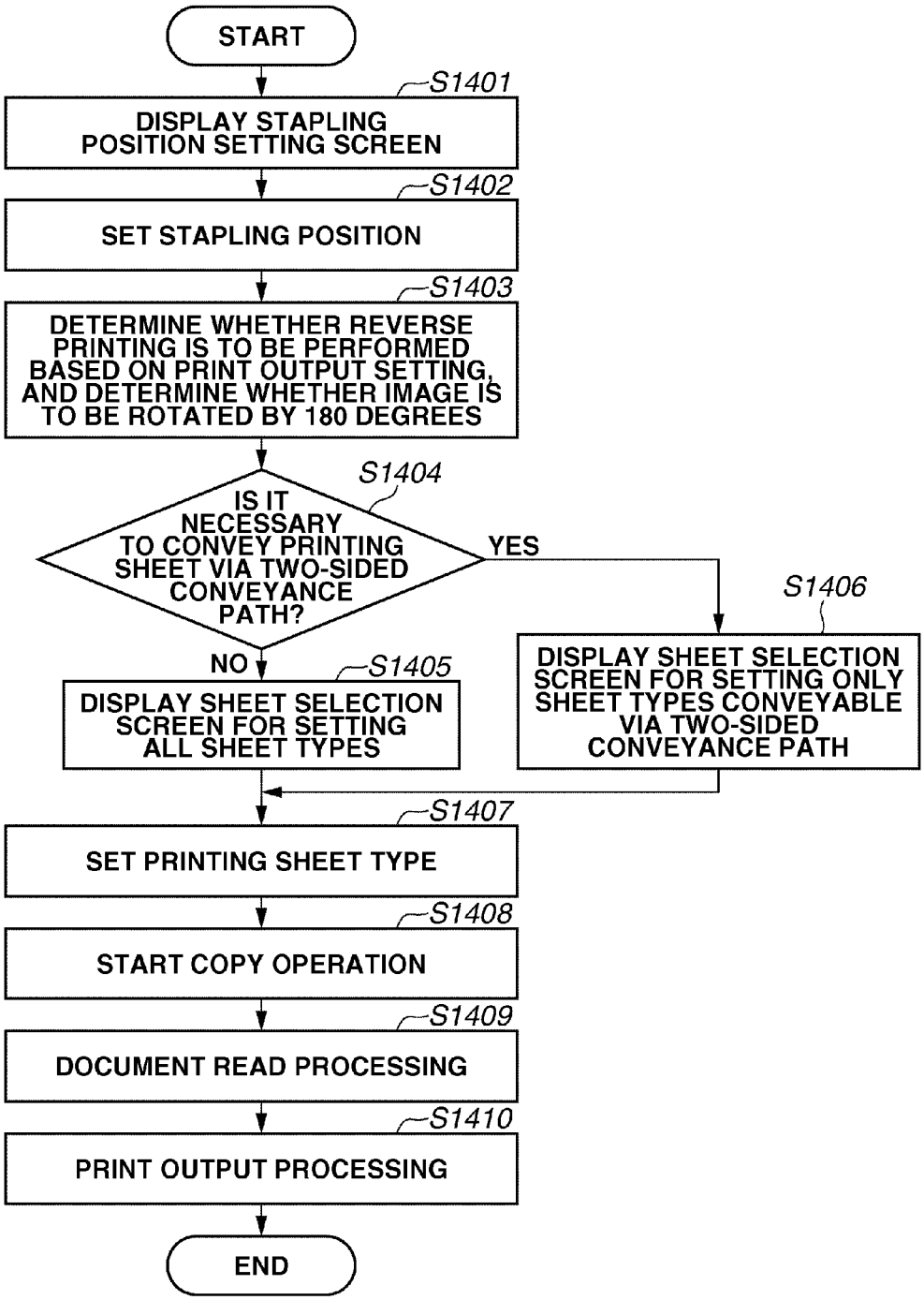
FIG. 14 is a flowchart illustrating a method for controlling a printing apparatus.

FIG. 14 is a flowchart illustrating a method for controlling a printing apparatus according to the fourth exemplary embodiment. Each step in the flowchart is controlled when the CPU 311 of the controller unit 300 reads a program stored in the ROM 313 or HDD 160 into the RAM 312, and then executes the program.

In step S1401, the CPU 311 displays the SET STAPLING POSITION screen 930. In step S1402, the CPU 311 receives an operation instruction from the user, and sets the stapling position. In step S1403, the CPU 311 determines which of forward printing and reverse printing is to be performed based on the stapling position and sheet orientation settings, and determines whether 180-degree rotation processing is to be applied to relevant images.

In step S1404, based on the forward printing or reverse printing information determined in step S1403, the CPU 311 determines whether it is necessary to convey the printing sheet in the two-sided conveyance path 44 by using the determination information stored in the HDD 160. When the CPU 311 determines that it is necessary to convey the specified printing sheet in the two-sided conveyance path 44 (YES in step S1404), then in step S1406, the CPU 311 displays on the operation unit 150 a SELECT SHEET TYPE screen 1500 (illustrated in FIG. 15) for allowing the user to set only a sheet type in the two-sided conveyance path 44, and the processing proceeds to step S1407. At this timing, the CPU 311 disables (grays out) "THICK PAPER" to prevent it from being selected.

Figure 15:
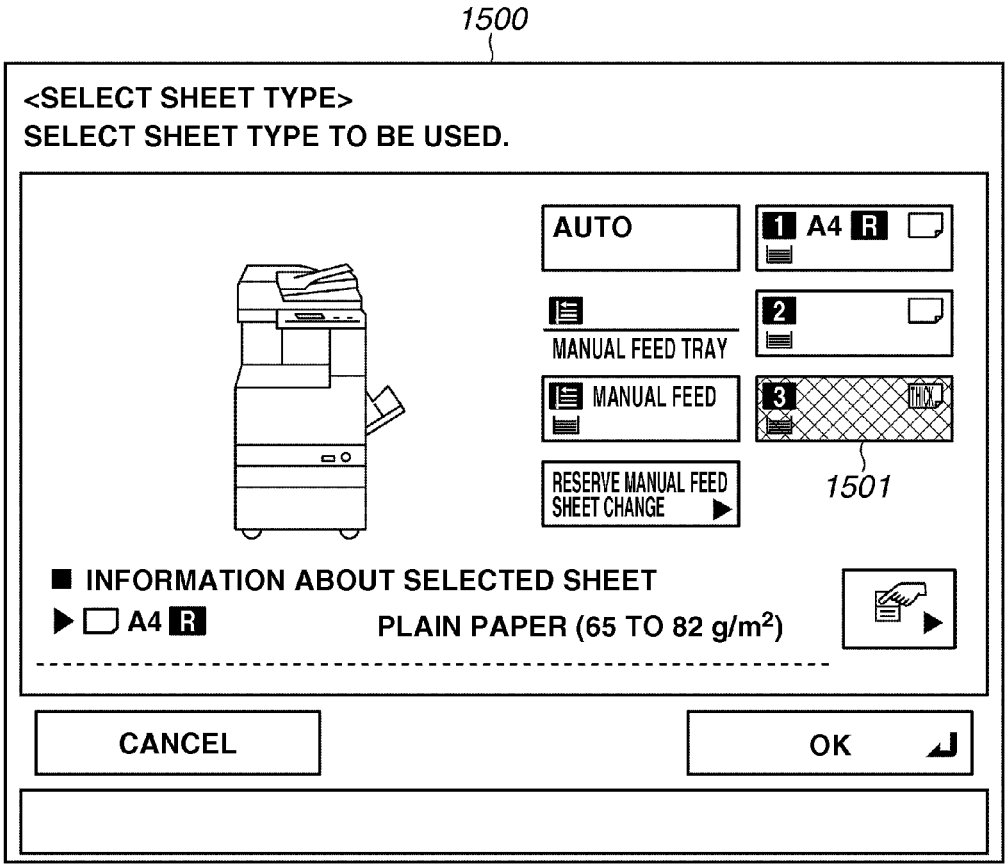
FIG. 15 illustrates an example UI screen of the printing apparatus.

More specifically, in the SELECT SHEET TYPE screen 1500 illustrated in FIG. 15, the CPU 311 disables (grays out)

a setting button 1501 for a sheet type unsuitable for two-sided conveyance to prevent it from being selected when pressed.

Otherwise, when the CPU 311 determines that it is not necessary to convey the printing sheet in the two-sided conveyance path 44 (NO in step S1404), then in step S1405, the CPU 311 displays on the operation unit 150 the SELECT SHEET TYPE screen 1500 for allowing the user to set all of sheet types. In step S1407, the CPU 311 sets as the printing sheet a sheet type selected by the user in the SELECT SHEET TYPE screen 1500 displaying all of sheet types. Thus, when two-sided conveyance is not to be performed, the CPU 311 displays in step S1405 the SELECT SHEET TYPE screen 1500 allowing the user to select a sheet type unconveyable in the two-sided conveyance path 44.

In step S1408, when the user presses the job start button (not illustrated) on the operation unit 150, a start job instruction is notified to the CPU 311 of the controller unit 300. In step S1409, upon reception of a read start instruction, the CPU 311 instructs the reader unit 200 to start reading the document. Then, the CPU 311 instructs the reader unit 200 to process image information of the read document to generate printable image data. In step S1410, the CPU 311 instructs the printing unit 100 to perform the print output processing for outputting the above-described image data to the selected sheet, and the processing exits this flowchart.

Although, in the flowchart illustrated in FIG. 14, the stapling position is set first and then the printing sheet type is selected, it is also possible to set the sheet type first and then set the stapling position. In this case, if the printing sheet type set first is of a sheet type unconveyable in the two-sided conveyance path 44, only a staplable position not requiring two-sided conveyance is selectable in the stapling position specification screen.

When a sheet cassette in which "THICK PAPER" is set is selected, the CPU 311 may perform the following control instead of the SELECT SHEET TYPE screen display control according to the above-described exemplary embodiments.

More specifically, for example, when the CPU 311 determines that a button corresponding to "THICK PAPER" is selected in the SELECT SHEET TYPE screen 1500 illustrated in FIG. 8, the CPU 311 may perform the following control. Specifically, when displaying the SET STAPLING POSITION screen 930 illustrated in FIG. 10B, the CPU 311 may disable (gray out) a stapling position requiring reverse printing to prevent it from being selected.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A printing apparatus comprising:

a printing unit configured to print an image on a sheet;

a reversing unit configured to reverse the sheet on which the image has been printed by the printing unit;

a first obtaining unit configured to obtain a staple position which is designated by a user among a plurality of staple positions, the plurality of staple positions including at least a first stapling position for which reversing of the sheet by the reversing unit is necessary and a second stapling position for which reversing of the sheet by the reversing unit is not necessary;

a second obtaining unit configured to obtain a type of the sheet on which the image is to be printed by the printing unit among a plurality of types, the plurality of types including at least a first type a sheet of which can be reversed by the reversing unit and a second type a sheet of which cannot be reversed by the reversing unit; and a control unit configured to determine, based on the staple position obtained by the first obtaining unit and the type of the sheet obtained by the second obtaining unit, whether or not, to start printing by the printing unit, and configured to display a screen for a user to change the staple position in a case where the control unit determines not to start printing.

2. The printing apparatus according to claim 1, wherein, when the staple position obtained by the first obtaining unit is the first stapling position and the type of the sheet obtained by the second obtaining unit is the second type, the control unit is configured to determine not to start printing by the printing unit.

3. The printing apparatus according to claim 1, wherein, when the staple position obtained by the first obtaining unit is the second stapling position and the type of the sheet obtained by the second obtaining unit is the first type, the control unit is configured to determine to start printing by the printing unit.

4. The printing apparatus according to claim 1, further comprising a notification unit configured to make a predetermined notification to a user when the control unit determines not to start printing by the printing unit.

5. The printing apparatus according to claim 4, further comprising a changing unit configured to change the type of the sheet on which the image is to be printed by the printing unit after the notification unit makes the predetermined notification.

6. The printing apparatus according to claim 1, further comprising a receiving unit configured to receive print data, wherein the first obtaining unit is configured to obtain the staple position from a setting included in the print data received by the receiving unit.

7. The printing apparatus according to claim 6, wherein the second obtaining unit is configured to obtain the type of the sheet from the setting included in the print data received by the receiving unit.

8. A control method for controlling a printing apparatus having a printing unit configured to print an image on a sheet and a reversing unit configured to reverse the sheet on which the image has been printed by the printing unit, the method comprising:

obtaining a staple position which is designated by a user among a plurality of staple positions, the plurality of staple positions including at least a first stapling position for which reversing of the sheet by the reversing unit is necessary and a second stapling position for which reversing of the sheet by the reversing unit is not necessary;

obtaining a type of the sheet on which the image is to be printed by the printing unit among a plurality of types, the plurality of types including at least a first type a sheet of which can be reversed by the reversing unit and a second type a sheet of which cannot be reversed by the reversing unit;

determining, based on the obtained staple position and the obtained type of the sheet, whether or not to start printing by the printing unit; and displaying a screen for a user to change the staple position in a case where the control unit determines not to start printing.

9. A non-transitory computer-readable storage medium storing a program that causes a computer to perform a method for controlling a printing apparatus having a printing unit configured to print an image on a sheet and a reversing unit configured to reverse the sheet on which the image has been printed by the printing unit, the method comprising:

obtaining a staple position which is designated by a user among a plurality of staple positions, the plurality of staple positions including at least a first stapling position for which reversing of the sheet by the reversing unit is necessary and a second stapling position for which reversing of the sheet by the reversing unit is not necessary;

obtaining a type of the sheet on which the image is to be printed by the printing unit among a plurality of types, the plurality of types including at least a first type a sheet of which can be reversed by the reversing unit and a second type a sheet of which cannot be reversed by the reversing unit;

determining, based on the obtained staple position and the obtained type of the sheet, whether or not to start printing by the printing unit; and displaying a screen for a user to change the staple position in a case where the control unit determines not to start printing.

10. A printing apparatus comprising:

a printing unit configured to print an image on a sheet;

a reversing unit configured to reverse the sheet on which the image has been printed by the printing unit;

a first obtaining unit configured to obtain a binding position which is designated by a user among a plurality of binding positions, the plurality of binding positions including at least a first binding position for which reversing of the sheet by the reversing unit is necessary and a second binding position for which reversing of the sheet by the reversing unit is not necessary;

a second obtaining unit configured to obtain a type of the sheet on which the image is to be printed by the printing unit among a plurality of types, the plurality of types including at least a first type a sheet of which can be reversed by the reversing unit and a second type a sheet of which cannot be reversed by the reversing unit; and a control unit configured to determine, based on the binding position obtained by the first obtaining unit and the type of the sheet obtained by the second obtaining unit, whether or not, to start printing by the printing unit, and configured to display a screen for prompting a user to change the binding position in a case where the control unit determines not to start printing.

11. The printing apparatus according to claim 10, wherein, when the binding position obtained by the first obtaining unit is the first binding position and the type of the sheet obtained by the second obtaining unit is the second type, the control unit is configured to determine not to start printing by the printing unit.

12. The printing apparatus according to claim 10, wherein, when the binding position obtained by the first obtaining unit is the second binding position and the type of the sheet obtained by the second obtaining unit is the first type, the control unit is configured to determine to start printing by the printing unit.

13. The printing apparatus according to claim 10, further comprising a receiving unit configured to receive print data, wherein the first obtaining unit is configured to obtain the binding position from a setting included in the print data received by the receiving unit.

14. The printing apparatus according to claim 13, wherein the second obtaining unit is configured to obtain the type of the sheet from the setting included in the print data received by the receiving unit.

15. The printing apparatus according to claim 10, wherein a sheet processing apparatus including a binding unit which is fixed at a predetermined position is to be connected to the printing apparatus.

16. A printing apparatus comprising:

a printing unit configured to print an image on a sheet;

a reversing unit configured to reverse the sheet on which the image has been printed by the printing unit;

a first obtaining unit configured to obtain a binding position which is designated by a user among a plurality of binding positions, the plurality of binding positions including at least a first binding position for which reversing of the sheet by the reversing unit is necessary and a second binding position for which reversing of the sheet by the reversing unit is not necessary;

a second obtaining unit configured to obtain a type of the sheet on which the image is to be printed by the printing unit among a plurality of types, the plurality of types including at least a first type a sheet of which can be reversed by the reversing unit and a second type a sheet of which cannot be reversed by the reversing unit; and a control unit configured to determine, based on the binding position obtained by the first obtaining unit and the type of the sheet obtained by the second obtaining unit, whether or not, to start printing by the printing unit, and configured to display a screen for prompting a user to change the type of the sheet to the first type suitable for being reversed and bound in a case where the control unit determines not to start printing.

17. The printing apparatus according to claim 16, wherein, when the binding position obtained by the first obtaining unit is the first binding position and the type of the sheet obtained by the second obtaining unit is the second type, the control unit is configured to determine not to start printing by the printing unit.

18. The printing apparatus according to claim 16, wherein, when the binding position obtained by the first obtaining unit is the second binding position and the type of the sheet obtained by the second obtaining unit is the first type, the control unit is configured to determine to start printing by the printing unit.

19. The printing apparatus according to claim 16, further comprising a receiving unit configured to receive print data, wherein the first obtaining unit is configured to obtain the binding position from a setting included in the print data received by the receiving unit.

20. The printing apparatus according to claim 19, wherein the second obtaining unit is configured to obtain the type of the sheet from the setting included in the print data received by the receiving unit.

21. The printing apparatus according to claim 16, wherein a sheet processing apparatus including a binding unit which is fixed at a predetermined position is to be connected to the printing apparatus.

* * * * *